US009144993B2

(12) United States Patent
Wells, Jr. et al.

(10) Patent No.: US 9,144,993 B2
(45) Date of Patent: Sep. 29, 2015

(54) RECIRCULATION OF INK

(71) Applicant: FUJIFILM Dimatix, Inc., Lebanon, NH (US)

(72) Inventors: Robert L. Wells, Jr., Thetford Center, VT (US); Bailey Smith, Bow, NH (US); Marlene McDonald, Norwich, VT (US); William Letendre, Etna, NH (US); Matthew Aubrey, White River Junction, VT (US); John Kelly, Lebanon, NH (US); Darrell Herrick, White River Junction, VT (US); Robert Hasenbein, Scottsdale, AZ (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 0 days.

(21) Appl. No.: 14/268,491

(22) Filed: May 2, 2014

(65) Prior Publication Data

US 2014/0240415 A1 Aug. 28, 2014

Related U.S. Application Data

(63) Continuation of application No. 13/786,360, filed on Mar. 5, 2013, now Pat. No. 8,752,946.

(60) Provisional application No. 61/606,880, filed on Mar. 5, 2012, provisional application No. 61/606,709, filed on Mar. 5, 2012.

(51) Int. Cl.

| | |
|---|---|
| ***B41J 2/18*** | (2006.01) |
| ***B41J 27/10*** | (2006.01) |
| ***B41J 2/14*** | (2006.01) |

(52) U.S. Cl.

CPC ..... *B41J 2/18* (2013.01); *B41J 2/14274* (2013.01); *B41J 27/10* (2013.01); *B41J 2002/14362* (2013.01); *B41J 2002/14491* (2013.01)

(58) Field of Classification Search

USPC ..... 347/84–85, 89, 74

See application file for complete search history.

(56) References Cited

U.S. PATENT DOCUMENTS

| | | | |
|---|---|---|---|
| 4,404,566 | A | 9/1983 | Clark et al. |
| 4,680,696 | A | 7/1987 | Ebinuma et al. |

(Continued)

FOREIGN PATENT DOCUMENTS

| | | |
|---|---|---|
| JP | 2009-323431 | 12/1997 |
| JP | 2001-205810 | 7/2001 |
| WO | WO 2011/146069 | 11/2011 |

OTHER PUBLICATIONS

International Search Report & Written Opinion, PCT/US2013/029213, mailed Jun. 24, 2013, 10 pages.

(Continued)

*Primary Examiner* — Kristal Feggins

(74) *Attorney, Agent, or Firm* — Fish & Richardson P.C.

(57) ABSTRACT

An apparatus includes an inkjet assembly having inkjet nozzles through each of which ink flows at a nominal flow rate as it is ejected from the nozzle onto a substrate. Ink is held under a nominal negative pressure associated with a characteristic of a meniscus of the ink in the nozzle when ejection of ink from the nozzle is not occurring. The apparatus includes recirculation flow paths, each flow path having a nozzle end at which it opens into one of the nozzles and another location spaced from the nozzle end that is to be subjected to a recirculation pressure lower than the nominal negative pressure so that ink is recirculated from the nozzle through the flow path at a recirculation flow rate. Each recirculation flow path has a fluidic resistance between the nozzle end and the other location such that a recirculation pressure at the nozzle end of the flow path that results from the recirculation pressure applied at the other location of the flow path is small enough so that any reduction in flow rate below the nominal flow rate when ink is being ejected is less than a threshold, or a change in the nominal negative pressure when ink is not being ejected is less than a threshold, or both.

25 Claims, 17 Drawing Sheets

(56) References Cited

U.S. PATENT DOCUMENTS

| | | | | |
|---|---|---|---|---|
| 4,891,654 | A | 1/1990 | Hoisington et al. | |
| 5,701,149 | A | 12/1997 | Pagnon et al. | |
| 5,818,485 | A | 10/1998 | Rezanka | |
| 6,244,694 | B1 | 6/2001 | Weber et al. | |
| 6,371,607 | B2 | 4/2002 | Wouters et al. | |
| 6,517,197 | B2 * | 2/2003 | Hawkins et al. | 347/74 |
| 8,091,988 | B2 | 1/2012 | McDonald | |
| 8,491,100 | B2 | 7/2013 | Moynihan | |
| 8,752,946 | B2 | 6/2014 | Wells, Jr. et al. | |
| 2008/0049063 | A1 | 2/2008 | Nakamura et al. | |
| 2009/0079801 | A1 | 3/2009 | Moynihan et al. | |
| 2009/0290000 | A1 | 11/2009 | McDonald | |
| 2011/0148988 | A1 | 6/2011 | Hoisington et al. | |
| 2012/0050427 | A1 | 3/2012 | Rike et al. | |

OTHER PUBLICATIONS

International Search Report & Written Opinion, PCT/US2013/029202, mailed Jun. 26, 2013, 17 pages.

* cited by examiner

RECIRCULATION OF INK

CLAIM OF PRIORITY

This patent application is a continuation of and claims priority under 35 U.S.C. §120 to U.S. patent application Ser. No. 13/786,360, filed on Mar. 5, 2013, which claims the benefit of the priority date of U.S. Provisional Patent Application No. 61/606,709, filed on Mar. 5, 2012, and U.S. Provisional Patent Application No. 61/606,880 filed on Mar. 5, 2012, pursuant to 35 U.S.C. 119. These applications are herein incorporated by reference in their entirety. This application incorporates U.S. application Ser. No. 13/786,154 filed on Mar. 5, 2013, by reference in its entirety.

TECHNICAL FIELD

This description relates to recirculation of ink.

The characteristics of ink at a nozzle of an inkjet, for example, can change during the time that elapses between print jobs. When the inkjet is first fired for the subsequent print job, the ink drop that is ejected can have characteristics different from subsequent ink drops that are formed from fresh ink. Recirculating ink near the nozzle can keep the ink fresh and ready for jetting during the time that elapses between print jobs. A nozzle plate, which includes a series of nozzle openings or orifices, often is the last element encountered by the ink before it is ejected from a printhead assembly. The nozzle plate contains nozzle tubes that extend through the thickness of the nozzle plate and end at the exposed face of the nozzle plate.

SUMMARY

In general, in an aspect, an apparatus includes an inkjet assembly having inkjet nozzles through each of which ink flows at a nominal flow rate as it is ejected from the nozzle onto a substrate. Ink is held under a nominal negative pressure associated with a characteristic of a meniscus of the ink in the nozzle when ejection of ink from the nozzle is not occurring. The apparatus includes recirculation flow paths, each flow path having a nozzle end at which it opens into one of the nozzles and another location spaced from the nozzle end that is to be subjected to a recirculation pressure lower than the nominal negative pressure so that ink is recirculated from the nozzle through the flow path at a recirculation flow rate. Each recirculation flow path has a fluidic resistance between the nozzle end and the other location such that a recirculation pressure at the nozzle end of the flow path that results from the recirculation pressure applied at the other location of the flow path is small enough so that any reduction in flow rate below the nominal flow rate when ink is being ejected is less than a threshold, or a change in the nominal negative pressure when ink is not being ejected is less than a threshold, or both.

Implementations may include one or more of the following features. The nominal negative pressure is ten times a magnitude of a meniscus pressure formed by a fluid at the nozzles. The nominal negative pressure is between 10-40 inches of water (inwg). The recirculation flow paths direct a fluid from the inkjet assembly into an external fluid reservoir. The fluidic resistance is defined in a nozzle recirculation plate. Each of the fluidic resistance includes V-shape channels defined in the nozzle recirculation plate. Each of the fluidic resistance is 5 (dyne/cm$^2$)/(cm$^3$/sec)). The recirculation flow paths direct a portion of fluid within the inkjet assembly away from the inkjet nozzles. The recirculation flow rate is 10% of the nominal jetting flow rate. A length of the V-shape channel is a first multiple of a manufacturing tolerance of the channel. A width of the V-shape channel is a second multiple of the manufacturing tolerance of the channel. The first multiple is much greater than the second multiple. A radius of curvature at a bend in the V-shape channel is large enough to prevent fluidic reflections at the bend. The apparatus further includes a second recirculation flow path that extends from a refill chamber, the second recirculation flow path from the refill chamber having a second fluidic resistance. The fluidic resistance between the nozzle end and the other location is within ±50% of the second fluidic resistance. The refill chamber is defined in a body of the inkjet assembly. The body includes carbon. The second recirculation flow path directs fluid out of the inkjet assembly. The inkjet assembly further includes an integrated recirculation manifold. The integrated recirculation manifold is in fluidic communication with the recirculation flow paths and the second recirculation flow path. The nominal negative pressure is applied through the integrated recirculation manifold. The recirculation flow paths of the nozzles and the second recirculation flow path are fluidically connected in parallel. The apparatus further includes a nozzle recirculation plate in which the fluidic resistances having V-shape channels are defined, a nozzle plate, a descender plate, and a collar. The nozzle recirculation plate is positioned between the nozzle plate and the descender plate and the integrated recirculation manifold is positioned between the collar and the descender plate, The carbon body is in contact with the integrated recirculation manifold.

In general, in an aspect, a recirculation flow rate for recirculation flow paths for nozzles of ink jets of an inkjet assembly is selected and a maximum external pressure to be applied to the recirculation flow paths is selected. A refill resistor having fluidic resistances to provide a fluid flow rate from the refill resistor that is similar to a sum of nozzle recirculation flow rates for the nozzles is designed.

Implementations may include one or more of the following features. The nozzle recirculation flow paths for the nozzles are connected in parallel. A fluid flow path from the refill resistor is connected in parallel to the nozzle recirculation flow paths from the nozzles. The maximum external pressure is between 10-40 inwg.

In general, in an aspect, a portion of a fluid in a nozzle of an inkjet of an inkjet assembly flows from the nozzle through a recirculation path to a reservoir separate from the inkjet assembly.

Implementations may include one or more of the following features. The portion of the fluid flows at a rate that is 10% of a flow rate of the fluid that is ejected from the nozzle. A second portion of the fluid is directed through a refill resistor; and the second portion of the fluid that has flown through the refill resistor is directed out of the inkjet assembly. The second portion of the fluid is directed to the refill resistor upstream of where the portion of the fluid is directed through the recirculation path. A flow rate of the second portion of the fluid through the refill resistor is within ±50% of a sum of flow rates from the nozzles of the inkjet assembly. A combined flow rate of the second portion of the fluid through the refill resistor and the sum of flow rates from the nozzles of the inkjet assembly is 10 μcc/sec.

In general, in an aspect, non-linear channels are formed in a nozzle recirculation plate, one end of each of the channels opening into a nozzle, and another end of each of the channels is connected to a fluid path that extends out of nozzle recirculation plate.

Implementations may include one or more of the following features. A length of each of the non-linear channel is a first multiple of a manufacturing tolerance of the channel. A width of the non-linear channel is a second multiple of the manufacturing tolerance of the channel, and the first multiple is much greater than the second multiple.

In general, in an aspect, an apparatus includes a plate through which at least portions of ink jetting nozzles extend from one face of the plate to another face of the plate, and V-shaped ink recirculation paths formed in the plate, each path having one end opening into the portion of a corresponding ink jetting nozzle and a second end for coupling to an ink recirculation path external to the plate.

These and other features and aspects, and combinations of them, can be expressed as systems, components, apparatus, methods, means or steps for performing functions, methods of doing business, and in other ways.

Other features, aspects, implementations, and advantages will be apparent from the description and the claims.

DESCRIPTION

Figure 6A:
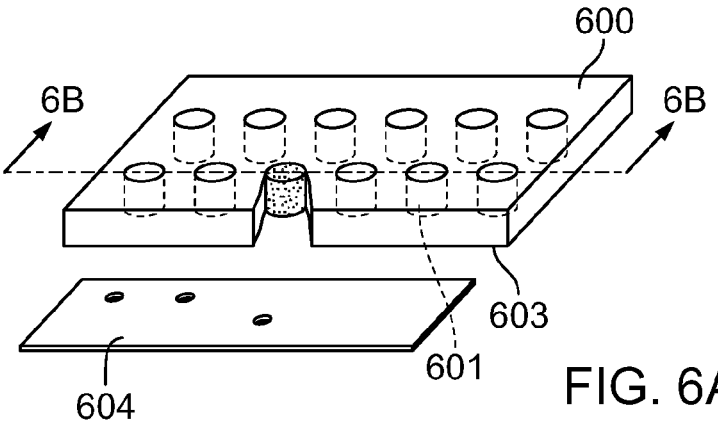
FIGS. 6A and 6B are schematic perspective views of a nozzle plate.

As shown in FIG. 6A, a nozzle plate 600 has nozzle openings 601. The nozzle plate 600 has an exposed surface 603 that faces a printing medium 604; each of the nozzle openings is at the exposed surface 603, and ink droplets from each jet are ejected from the nozzle opening toward a substrate during printing.

Figure 4A:
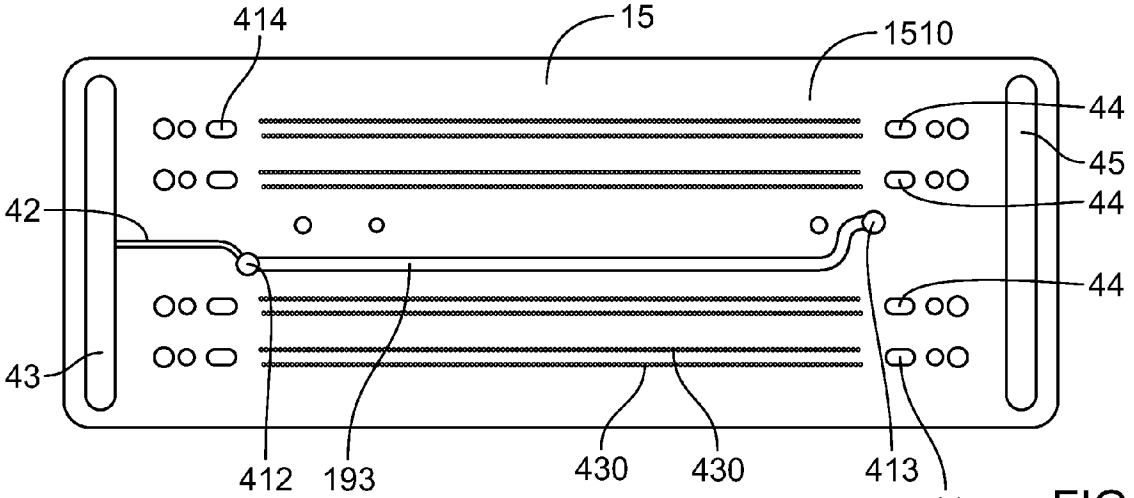
FIGS. 4A-4D are top, bottom, left and right sectional views of a manifold.
Figure 4B:
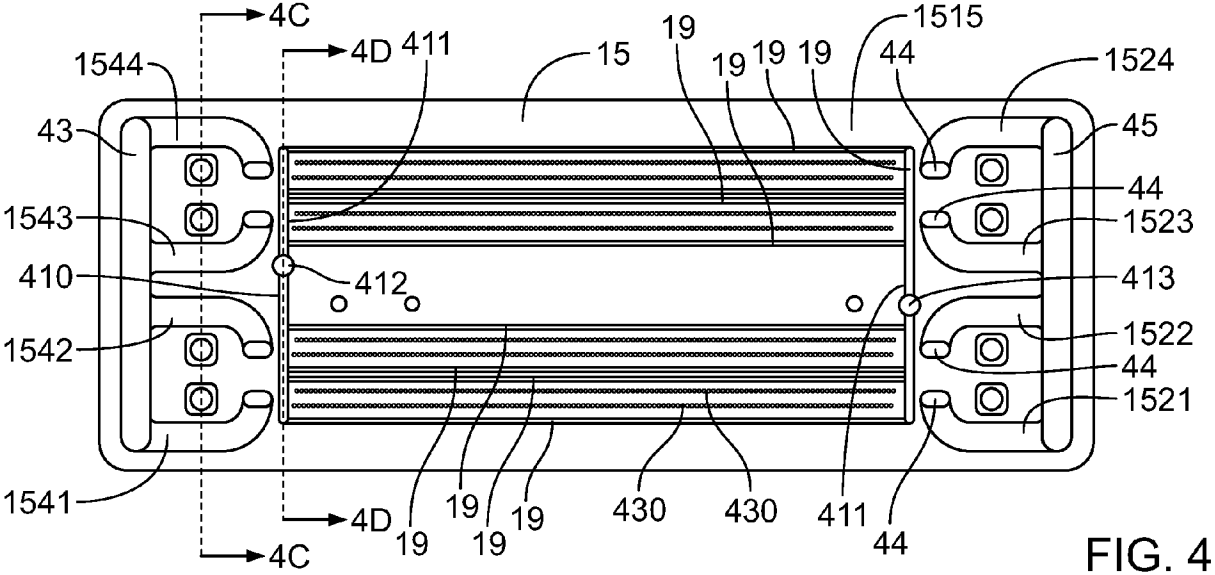
Figure 4C:
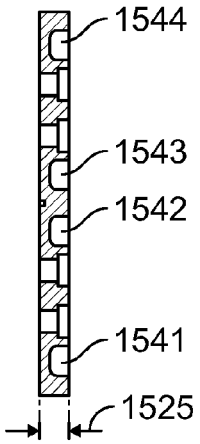
Figure 4D:
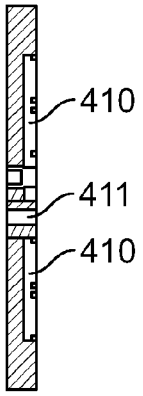
Figure 4E:
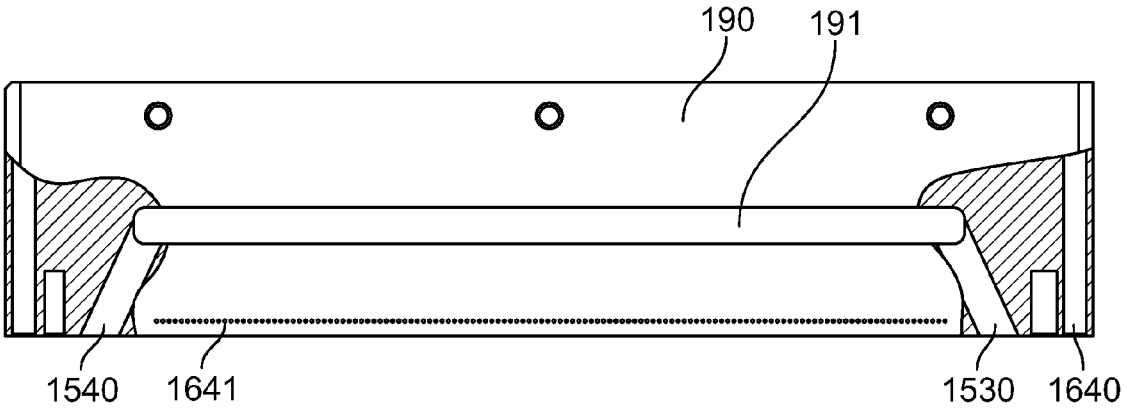
FIG. 4E is a side view of a carbon body.
Figure 4F:
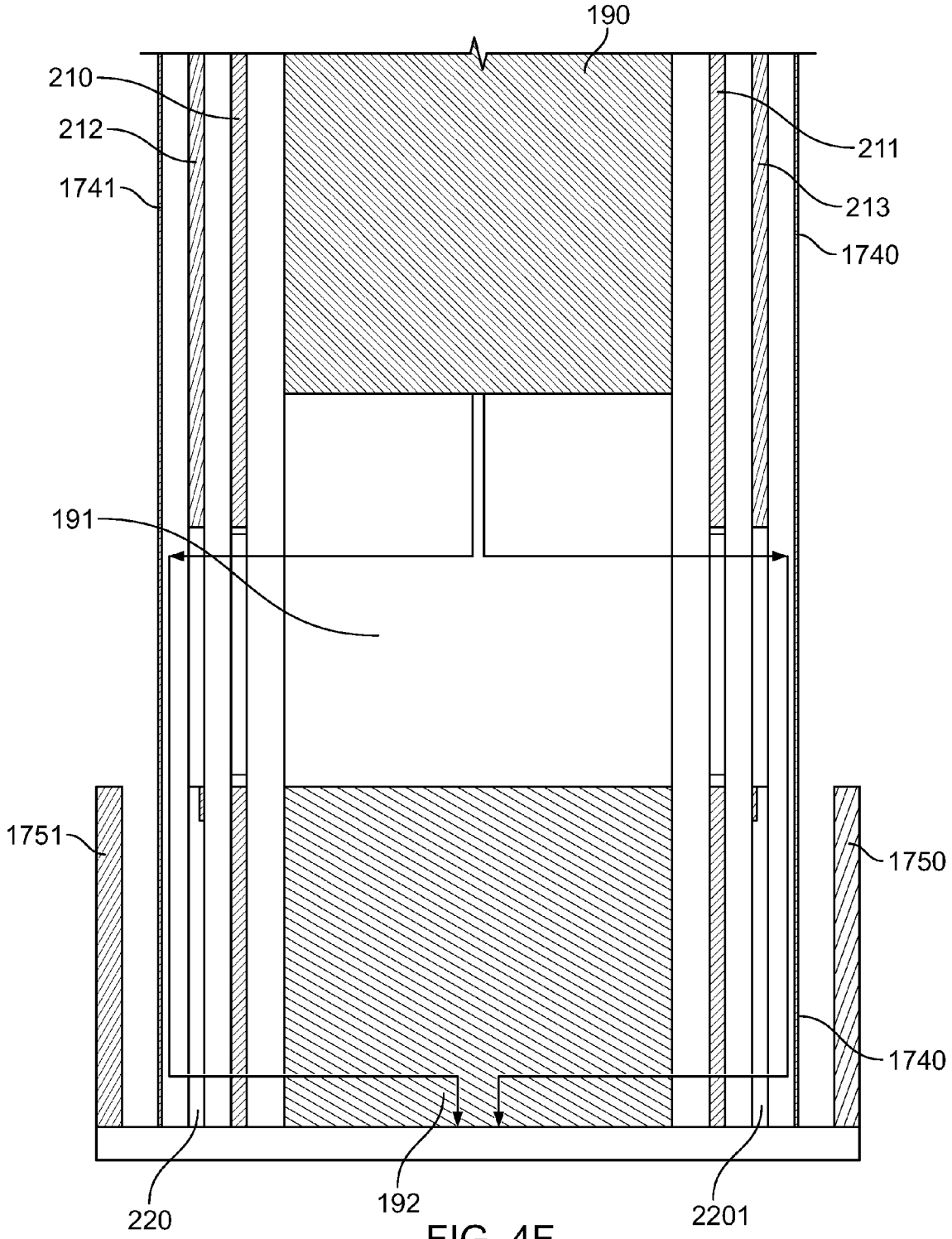
FIG. 4F is a schematic view of an arrangement of parts within an inkjet array module.
Figure 6B:
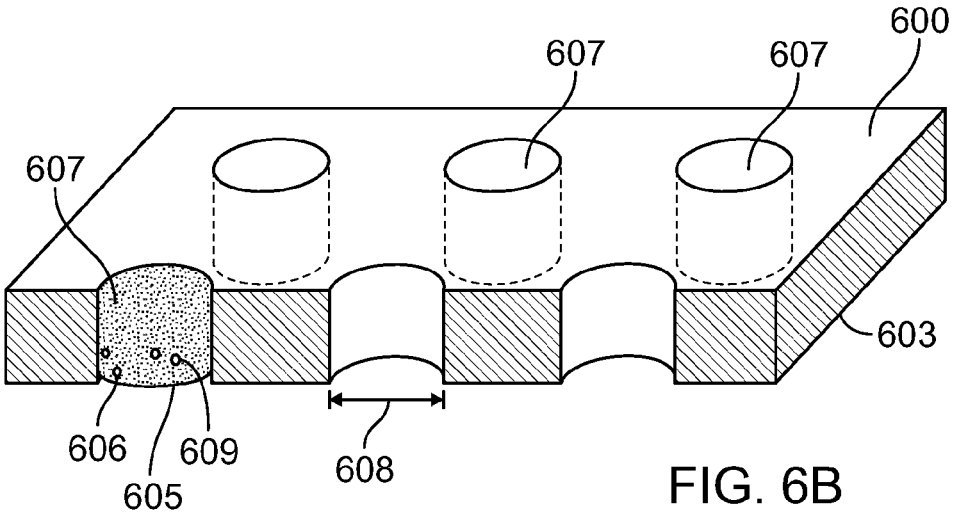
Figure 8A:
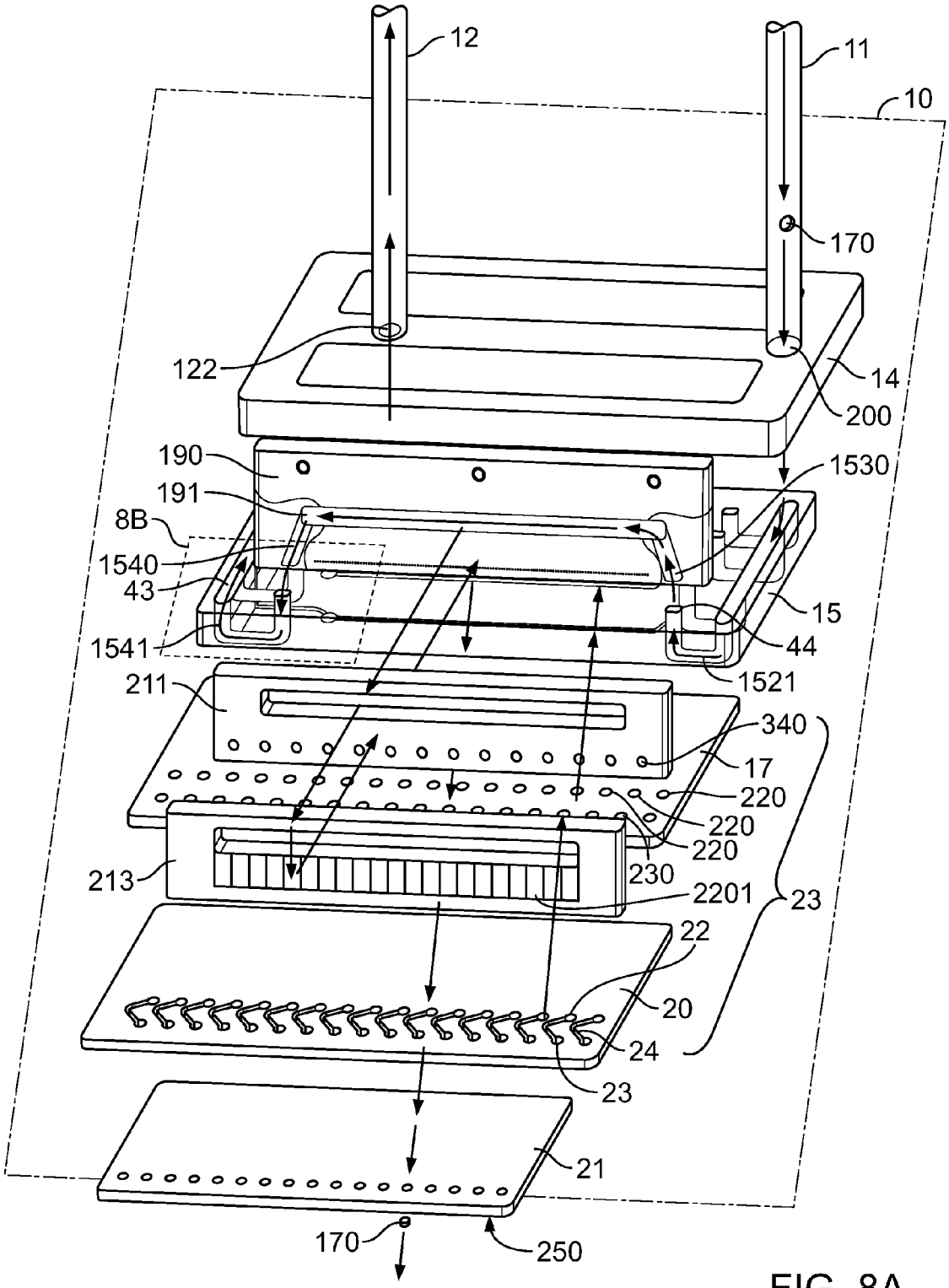
FIGS. 8A and 8B are schematic perspective views of the ink flow through the printhead assembly.

As shown in FIG. 6B, the nozzle opening for each jet lies at the end of a nozzle tube 607 in a nozzle plate 600. At times when ink droplets are not being ejected from the nozzle opening, ink is held in the nozzle tube to prepare the nozzle for subsequent jetting of droplets. The ink in the nozzle tube then forms a meniscus 605 of ink 170 to define a liquid-air interface 606 within the nozzle tube 607 The meniscus 605 may have an outer rim 691 at the nozzle opening and a concave surface 693 caused by a negative pressure applied to the ink 170 upstream of the nozzle to keep it from leaking from the nozzle opening. (We often use the term nozzle interchangeably with the term nozzle tube.) The meniscus 605 extends over the diameter 608 of the nozzle opening 601 and is positioned within the nozzle tube 607 of the nozzle opening 601, away from the exposed surface 603. The ink, which can include pigments and solvents, may dry or undergo other changes in its characteristics at the nozzle opening 601 and within the nozzle tube, for example, when volatile solvents 609 evaporate from the ink through the liquid-air interface 606 of the meniscus 605. Ink that is held in and flows through various parts of the inkjet array module is also subject to settling of pigments and to other changes in characteristics that can adversely impact the quality of the printing and the maintenance of the inkjet array module. To reduce these effects, ink can be recirculated continuously while the inkjet array module is in operation or in an idle state. For this purpose, recirculation can be carried out, for example, at a refill chamber 191 (FIGS. 1E, 4E and 8A) of an inkjet array module 16A (FIG. 1E), upstream of individual pumping chambers 2201 (FIGS. 4F and 8A). Several inkjet array modules can be installed in a printhead assembly 10.

The refill chamber 191 houses a larger volume of ink 170 compared to the ink contained in individual pumping chambers 2201. Recirculating ink at the refill chamber 191 helps to prevent heavier pigments of inks 170 from settling there. Recirculating at the refill chamber 191 helps to ensure that ink having specific characteristics (for example, viscosity, temperature, amount of dissolved gases) is delivered to individual pumping chambers 2201 for jetting. In addition, a deaerator can be arranged upstream of the refill chamber to remove gases from the ink supplied to the refill chamber 191. In that way, inks having very low dissolved gas content can be supplied to pumping chambers 2201 for jetting. Recirculating ink 170 at the refill chamber 191 also facilitates changing of inks because the refill chamber recirculation flow paths provide a fluid path for the ink 170 in the refill chamber 191 to be actively removed (using back pressure exerted from an external source 120) from the printhead assembly 10 in order for new inks to be introduced to the printhead assembly 10. In the absence of the recirculation fluid paths, a particular ink would need to be flushed from the nozzles 249 before new ink can be introduced to the printhead assembly 10 (assuming that the printhead assembly 10 is not disassembled between changes of ink). Recirculation of ink also helps with priming and recovery. An empty printhead containing air can be primed by introducing a jetting fluid into the printhead such that a meniscus of the jetting fluid is formed at one or more nozzles of the printhead. Priming generally refers to the preparation of a meniscus at the nozzle.

In addition to recirculating ink at the refill chamber, recirculating ink 170 that is being held in and upstream of the nozzle 249 from which ink droplets are to be ejected helps to ensure that fresh ink, of the same characteristics (e.g., viscosity, temperature, and solvent content) as the ink that is in the refill chamber 191 is held in the nozzle 249, for example, during the time when ink is not actually being jetted. Recirculation helps to ensure that, for example, the first droplet jetted from the nozzle opening 250 after a period of no jetting is of the same quality, size, and characteristics as other droplets that are jetted before and after the period of no jetting. This allows for better jetting performance.

For example, inks that contain volatile solvents may be dried out within the nozzle 249 when the meniscus 605 of the ink 170 at the ink-air interface 606 loses the volatile solvents 609 at the interface to the atmosphere, in the absence of recirculation. Some inks may absorb air through the ink-air interface 606 at the meniscus 605 when the ink is exposed to air. This absorption may cause bubble formation within the printhead assembly 10 that can render the printhead inoperable when these bubbles are trapped in ink passages in the printhead assembly 10.

Figure 7:
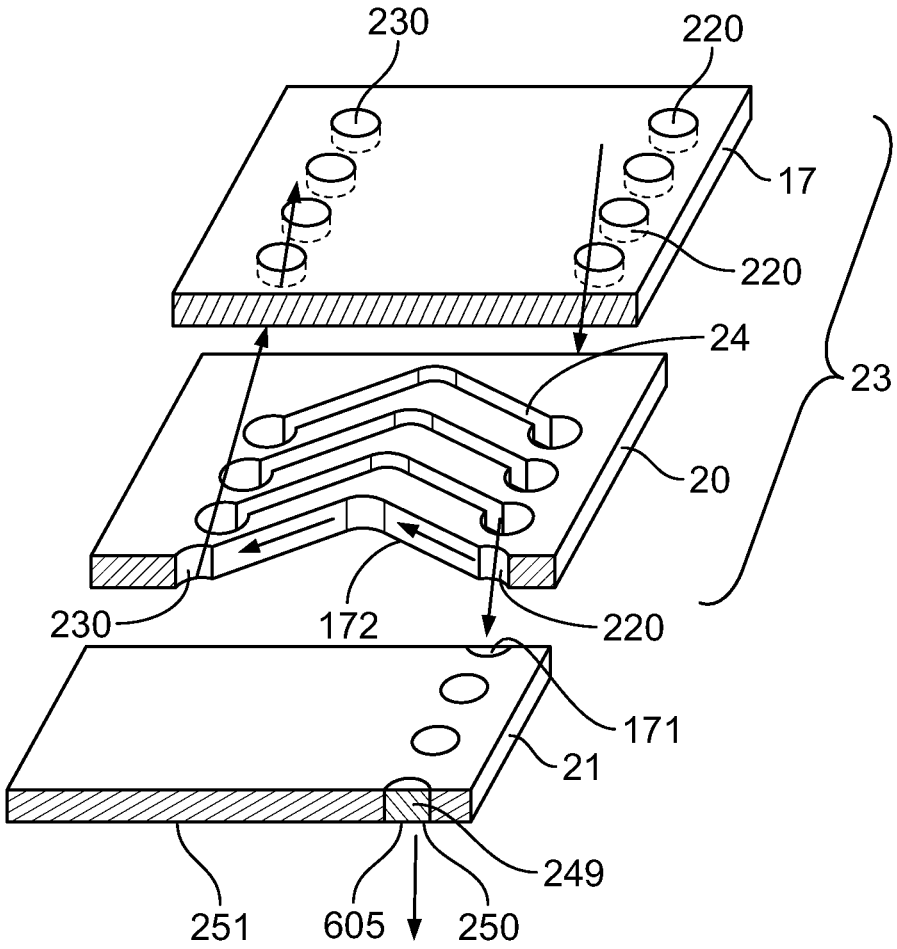
FIG. 7 are perspective views of the descender plate, the nozzle recirculation plate and the nozzle plate.

To recirculate ink that is held in the nozzle tube at times when the inkjet is not ejecting droplets from the nozzle opening can be done by providing a recirculation path that opens at one end into the nozzle tube and leads at its other end to a recirculation supply of ink. We describe such nozzle recirculation paths below. Note that, as shown in FIG. 7, the nozzle tube 607 includes not only the segment that lies within the nozzle plate but also a collinear segment within a nozzle recirculation plate 20, and at least part of the nozzle recirculation path is provided in the nozzle recirculation plate, as described in more detail below.

Providing such recirculation paths from the nozzle tubes is not trivial due to space constraints in body in which the nozzles are formed. The inclusion of recirculation paths to closely spaced nozzles may also create cross talk between jets (explained in more detail below). Recirculation may also reduce efficiency of the jetting, because it draws some ink from the nozzle tube and reduces the ink pressure in the nozzle tube, which can reduce the amount of jetting fluid that is being ejected in a droplet from the nozzle opening onto the printing substrate. The recirculation flow also may perturb the meniscus pressure at the nozzle leading to a heightened sensitivity of the nozzle to the fluctuations in the recirculation pressure.

Ink flows at a nominal flow rate as it is ejected through each of the nozzle onto a substrate. Ink is held under a nominal negative pressure associated with a characteristic of a meniscus of the ink in the nozzle when ejection of ink from the nozzle is not occurring. Each flow path having a nozzle end at which it opens into one of the nozzles and another location spaced from the nozzle end that is to be subjected to a recirculation pressure lower than the nominal negative pressure so that ink is recirculated from the nozzle through the flow path at a recirculation flow rate. Each recirculation flow path has a fluidic resistance between the nozzle end and the other location such that a recirculation pressure at the nozzle end of the flow path that results from the recirculation pressure applied at the other location of the flow path is small enough so that any reduction in flow rate below the nominal flow rate when ink is being ejected is less than a threshold, or a change in the nominal negative pressure when ink is not being ejected is less than a threshold, or both.

In some inkjet heads, the ink 170 is split into two paths in a recirculation structure immediately upstream of the nozzle plate 21. One of the paths conducts the ink to the nozzle plate 21, from which ink is ejected. The other path provides a path for the ink to flow out of the printhead assembly 10 into an external ink reservoir 110.

A recirculation flow rate for recirculation flow paths for nozzles of ink jets of an inkjet assembly is selected and a maximum external pressure to be applied to the recirculation flow paths is selected. A refill resistor having fluidic resistances to provide a fluid flow rate from the refill resistor that is similar to a sum of nozzle recirculation flow rates for the nozzles is designed. A portion of a fluid in a nozzle of an inkjet of an inkjet assembly flows from the nozzle through a recirculation path to a reservoir separate from the inkjet assembly.

Figure 1A:
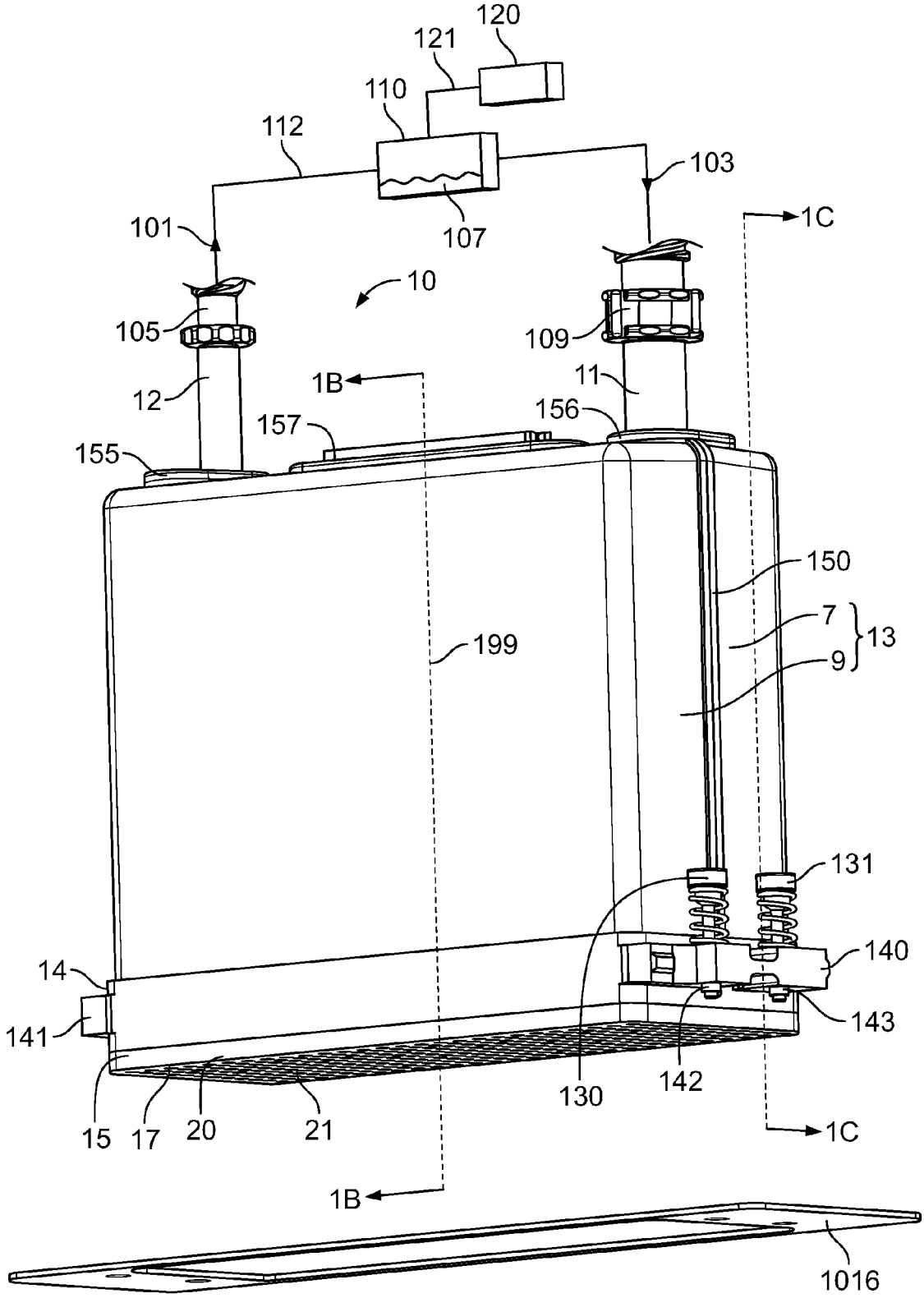
FIG. 1A-1C show isometric views of a printhead assembly.

In FIG. 1A, an inkjet printhead assembly 10 has an ink inlet 11, and an ink outlet 12. The ink inlet 11 is connected to an external ink reservoir 110 through a tubing coupler 109 and piping 111 so that the ink reservoir 110 supplies ink 107 to the ink inlet 11 (in the direction indicated by arrow 103). The external ink reservoir 110 is also connected to the ink outlet 12 through a tubing coupler 105 and piping 112 and receives returned ink from the ink outlet 12 (in the direction indicated by arrow 101). The external ink reservoir 110 is connected to a vacuum source 120 through vacuum connections 121. The vacuum source 120 can exert a vacuum pressure on the ink in the ink reservoir 110.

The printhead assembly 10 includes a rigid housing 13 formed of two half-pieces 9 and 7, which (when assembled) encapsulate components of the printhead assembly 10. Examples of materials from which the two half-pieces of rigid housing 13 can be made include thermoplastics. The ink inlet 11 enters the housing 13 through a ring-shaped resilient support 156 that is captured in a round aperture 1001 formed on the upper wall of the housing 13 when the two half-pieces are mated.

Similarly, the ink outlet 12 leaves the housing 13 through a resilient ring support 155 that is captured in a round aperture 1004 formed in the upper wall of the housing 13 when the two half-pieces are mated. The bottom 1006 of the housing 13 has an inwardly projecting rim 1008 on both ends that mates with corresponding grooves 1010 on opposite ends of a collar 14. The bottom surface 1012 of the collar 14 is joined using adhesives 1014 to an integrated recirculation manifold 15. The integrated recirculation manifold 15 is a separate piece from the collar, and integrates the flow paths of two recirculation systems. Details of the recirculation systems are described below.

The integrated recirculation manifold 15 is affixed using adhesives, such as epoxies, to a laminated piece 23 that includes a stainless steel descender plate 17 and a stainless steel nozzle recirculation plate 20. The bottom surface 1018 of the recirculation plate 20 is then joined adhesively to a nozzle plate 21. The collar, the recirculation manifold, the descender plate, the recirculation plate, and the nozzle plate all have the same peripheral size and shape.

The collar 14, the integrated recirculation manifold 15, the descender plate 17, the nozzle recirculation plate 20 and the nozzle plate 21 jointly form a nozzle plate assembly 221. The collar and the integrated recirculation manifold 15 may be made of carbon, while the nozzle plate 21 may be an electroform plate of nickel.

The collar 14 includes two protrusions 140 and 141. The protrusion 140 has two through-holes 142 and 143 through which two screws 130 and 131 can extend, while the protrusion 141 has a single through-hole 144 through which a screw 133 can extend. The screws 130, 131 and 133 allow the printhead assembly 10 to be mounted, along with other printhead assemblies, on a print bar 1016, or other supports. The housing 13 can be opened into two halves along a seam 150. A multiple-contact electrical connector 157 at the top of the assembly can receive a mating connector of a signal cable to enable signals to be carried to and from actuation elements of the printhead assembly used to trigger jetting of ink from each inkjet, for example. Using the three mounting screws, the tubing couplings 105 and 109, and the electrical connector 157, the entire printhead assembly can be easily removed as a stand-alone assembly from the print bar 1016, for maintenance, storage, or replacement.

Figure 1B:
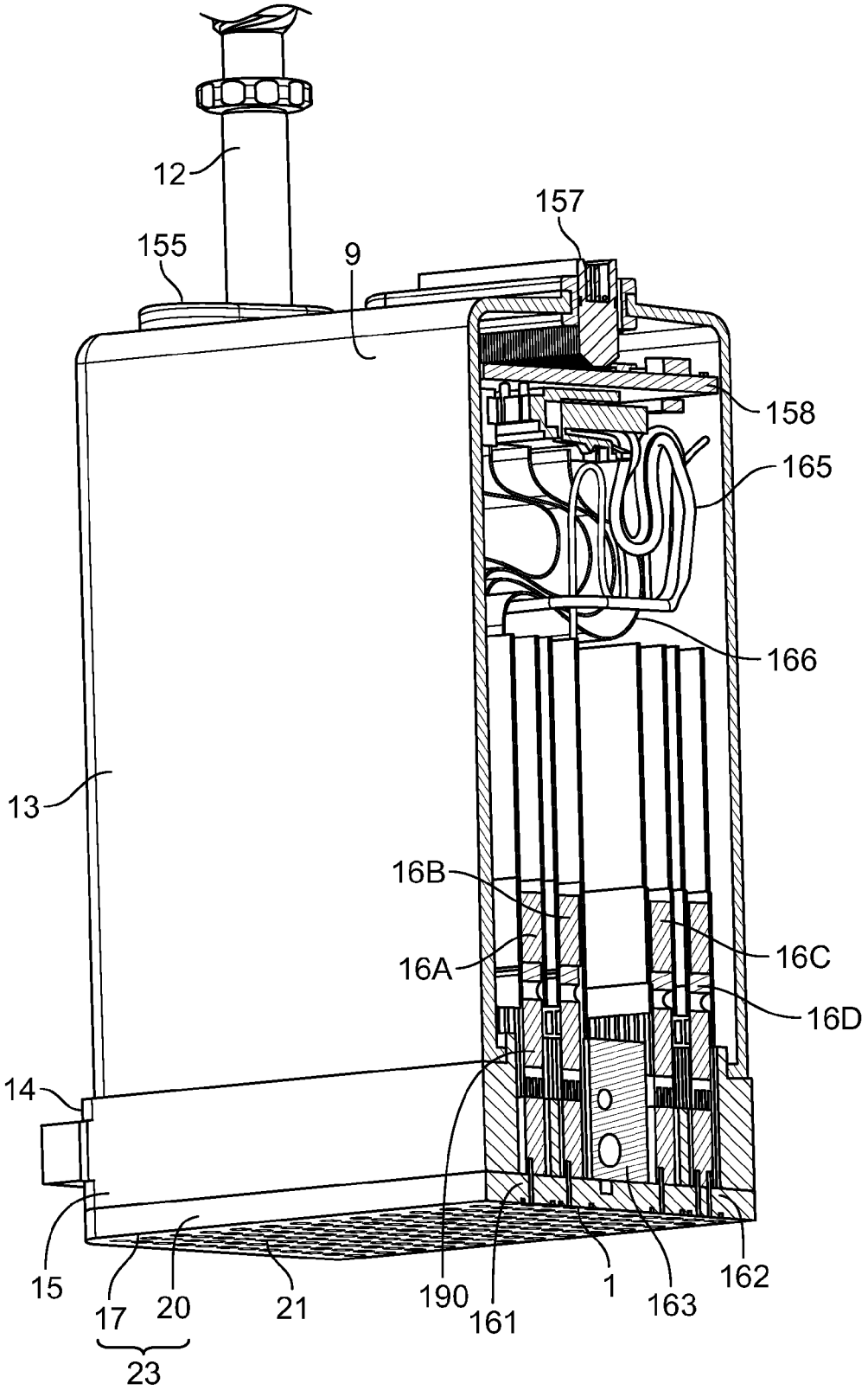

As shown in FIG. 1B, within the printhead assembly four inkjet array modules 16A-16D are arranged in two pairs, each pair mounted in corresponding long rectangular slots 161 and 162 in the collar 14. Slots 161 and 162 are separated by a wall 163 that extends along the length of the collar 14. Each array module includes two flexible circuits 166 that are connected to circuitries mounted on a circuit board 158 supported within the housing 13. A heater wire 165 is optionally included in some printhead assembly 10. The heater wire 165 can be used to heat up the ink 107 that is supplied into each of the inkjet array modules 16A-16D.

Figure 1C:
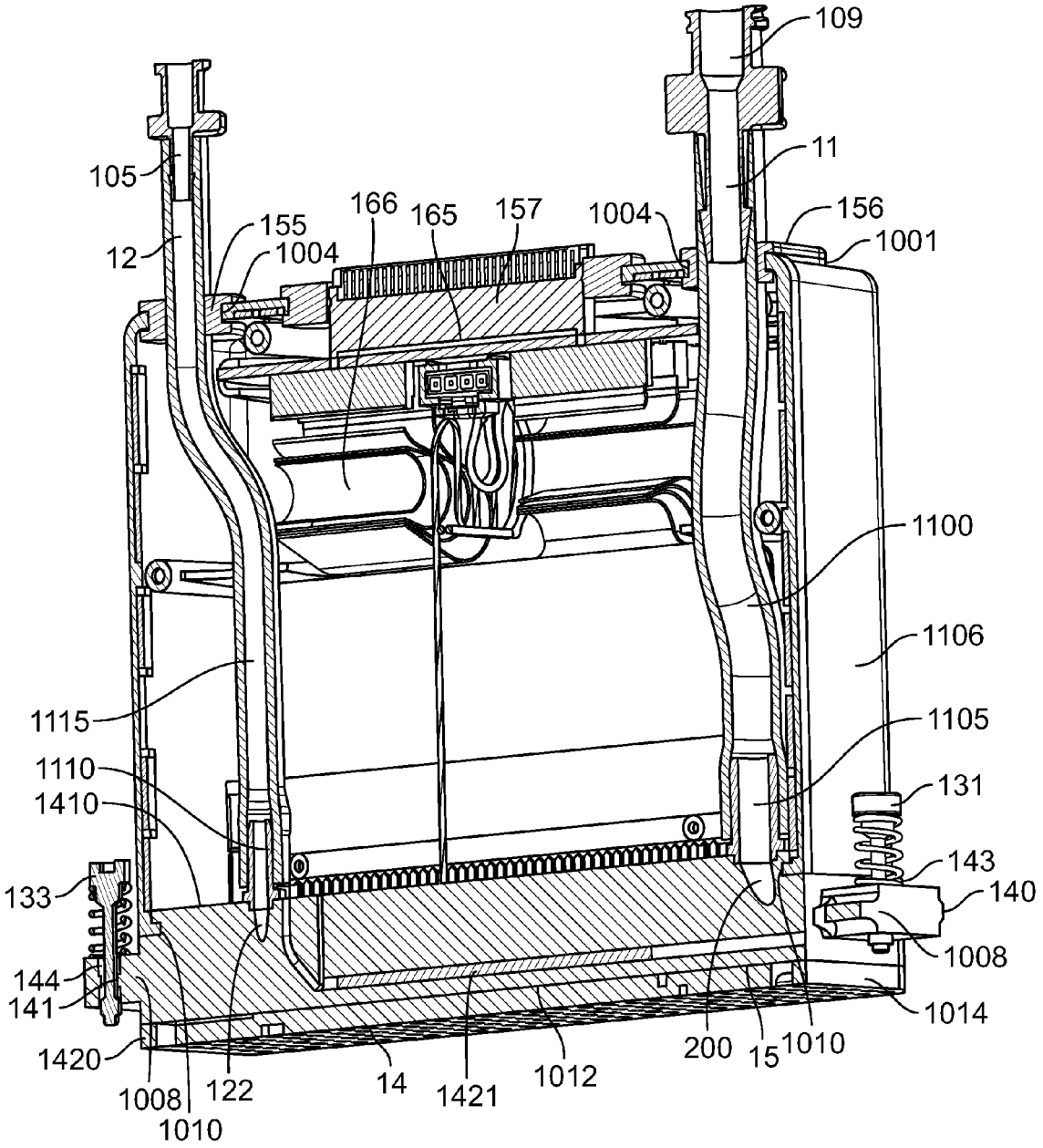

The ink inlet 11 is connected, as shown in FIG. 1C, to the collar 14 at a throughhole 200 in the wall 163 by way of a piping 1100 and a coupler 1105. The ink outlet 12 is connected to the collar 14 at a throughhole 122 in the wall 163 of the collar 14 through a coupler 1110 and a piping 1115. A second return 1421 from the recirculation manifold is formed as a horizontal channel in the collar 14. The four pairs of flexible circuits 166 are connected to electronic circuitries 171 arranged on the board 158.

Figure 1D:
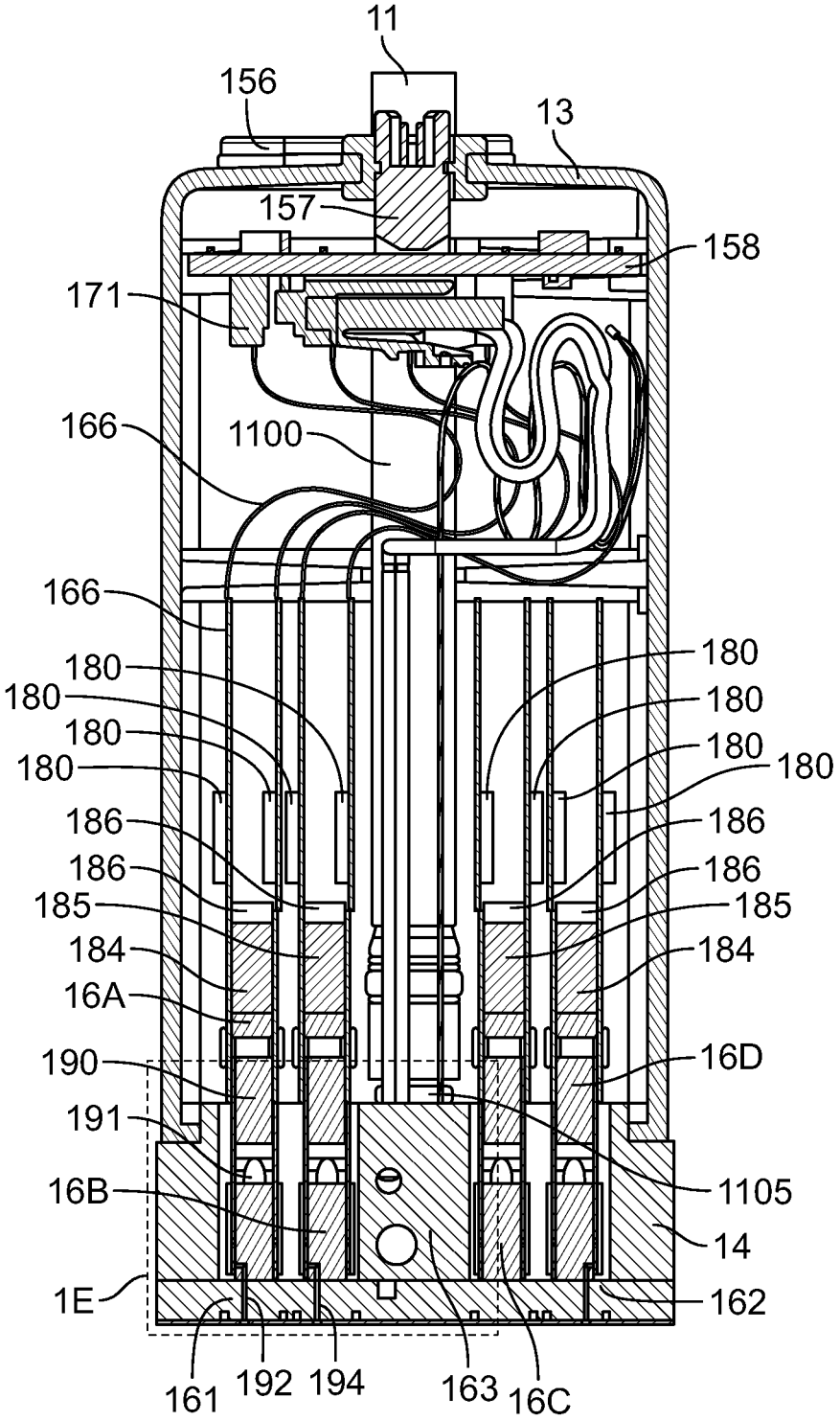
FIGS. 1D-1H are views of a printhead assembly.

FIG. 1D shows a cross-sectional end view of the printhead assembly 10. Integrated circuits 180 are mounted on each flex circuit 166. Aluminum clamps 184 span the length of each of the inkjet array modules 16A-16D (into and out of the plane of the drawing). There is a screw 185 at each end of the aluminum clamp 184, the screw having a screw head 186 positioned above the clamp 184. Each of the array modules 16A-16D includes a carbon body 190, in which a refill chamber 191 is defined. All four refill chambers 191 for the array modules 16A-16D are fluidically connected. The carbon body 190 is sandwiched between stiffener plates 210, 211 and cavity plates 212 and 213 (shown more clearly in FIGS. 1F and 4F) An enlarged view of the lower left portion of the printhead assembly (marked with a rectangle) is shown in FIG. 1E.

Figure 1E:
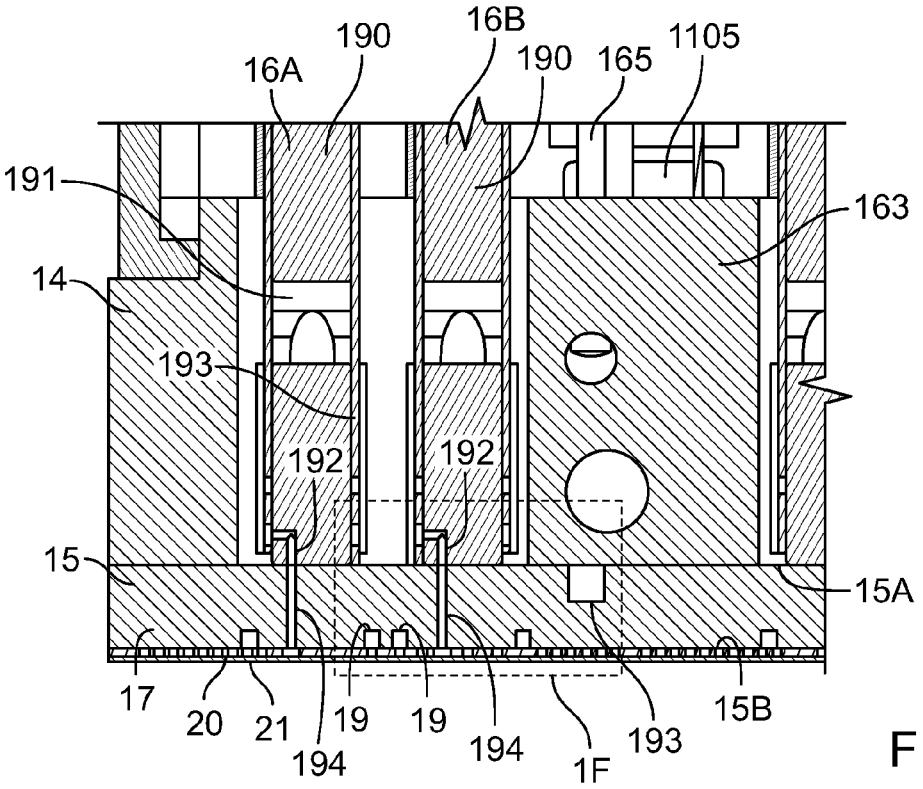
Figure 1F:
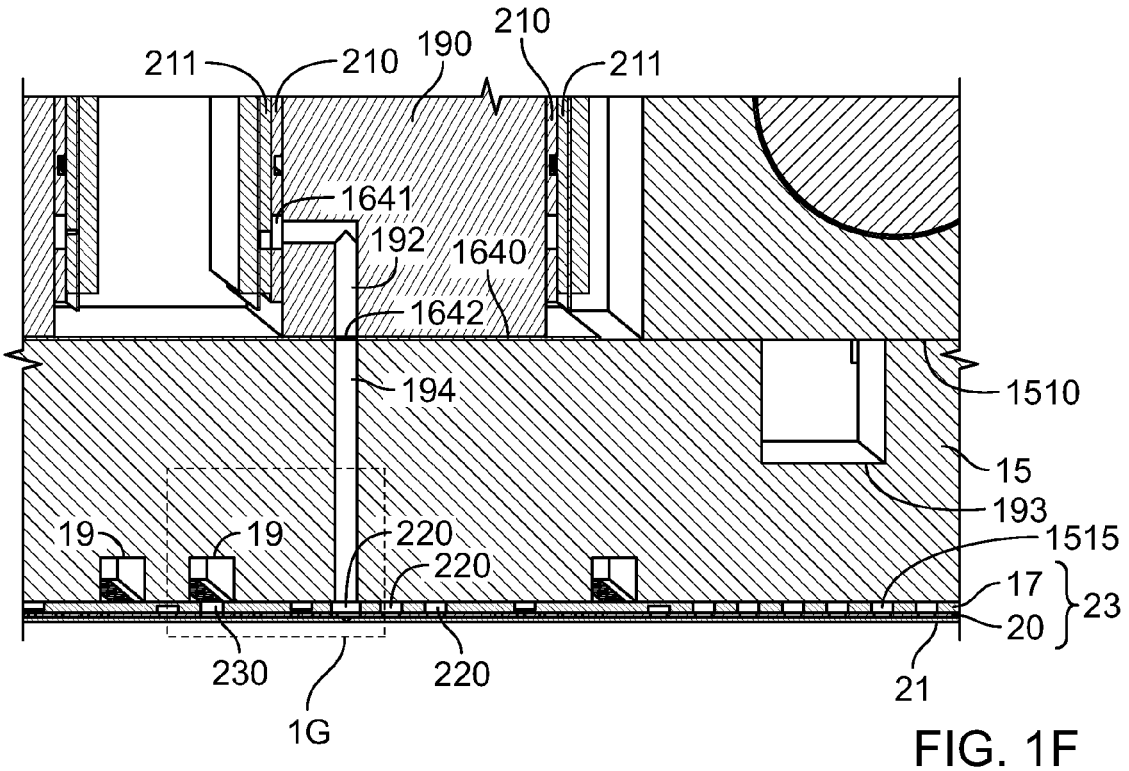

FIG. 1E shows two array modules 16A and 16B. A descender 192 is defined in the carbon body 190 for each nozzle of the module. The descender 192 includes a 90 degree bend joining an orifice 1641 to an orifice 1642 at a bottom edge 1640 of the carbon body 190. The descender 192 extends through the integrated recirculation manifold 15 as a descender 194. The integrated recirculation manifold has an upper surface 1510 and a lower surface 1515. A nozzle recirculation return manifold 193 and a refill recirculation resistor 42 is defined in the upper surface 1510 of the integrated recirculation manifold 15 (FIG. 4A). A total of eight recirculation return manifolds 19 are defined in the lower surface 1515, of which five are shown in FIG. 1E. An enlarged view of the lower middle portion of FIG. 1E is shown in FIG. 1F.

The descender 194 defined in the integrated recirculation manifold 15 connects an end of descender 192 to a descender 220 defined in descender plate 17. An enlarged view of the lower left portion of FIG. 1F is shown in FIG. 1G.

Figure 1G:
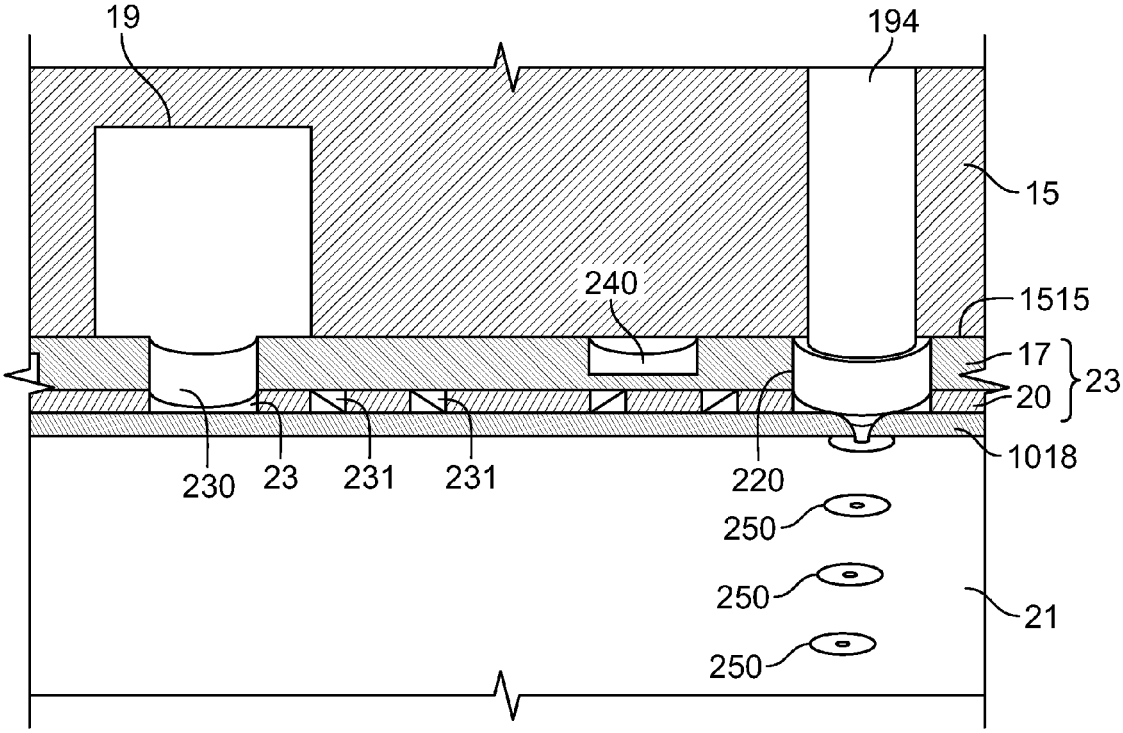

FIG. 1G shows a bottom up view (viewed from the nozzle plate 21) of a portion of the nozzle plate assembly 221. The nozzle plate assembly includes the collar 14, the integrated recirculation manifold 15, the descender plate 17, the nozzle recirculation plate 20 and the nozzle plate 21. The nozzle plate 21 contains a number of nozzle openings 250. Each nozzle opening 250 in the nozzle plate 21 is smaller in diameter than any section above it. The top portions of the figure shows the recirculation return manifold 19 defined in the lower surface 1515 of the integrated recirculation manifold 15. Below the manifold 15 is the descender plate 17 in which a number of descenders 220 and ascenders 230 are defined. A void 240, also known as a "glue sucker", serves as an adhesive control feature by holding glue squeezed out between the recirculation manifold 15 and the descender plate 17 during assembly. The descenders 220 are aligned with a port 22 in the nozzle recirculation plate 20. The descender plate 17 is adhesively bonded to the nozzle recirculation plate 20 to form the laminate piece 23. The port 22 in the nozzle recirculation plate 20 is connected via a V-shaped nozzle recirculation resistor or channel 24 to a port 232 which is aligned with the ascender 230 in the descender plate 17 to the recirculation return manifold 19. There are equal numbers of descenders 220 and ascenders 230 and the total number of descenders 220 matches the total number of nozzle openings 250. In other words, each nozzle opening 250 has its own dedicated nozzle recirculation resistor 24. The nozzle recirculation resistor 24 is, for example, a fluidic channel. Elements 231 are cross sections of other V-shaped nozzle recirculation resistors 24 that belong to other nozzles 250 arranged into and out of the plane of the drawing in FIG. 1G. The ink that is delivered to the recirculation return manifold 19 exits the printhead assembly 10 through the ink outlet 12.

Figure 1H:
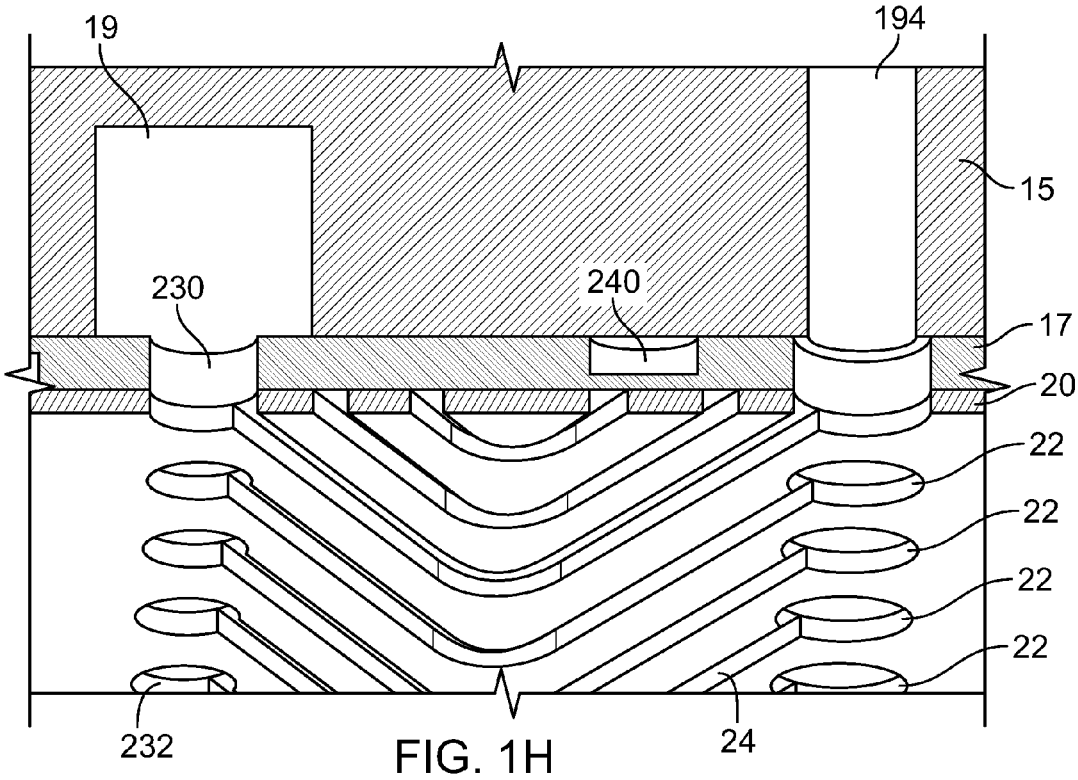

FIG. 1H shows a similar view of the nozzle plate assembly 221, but without the nozzle plate 21. Each V-shaped nozzle recirculation resistor 24 is connected to a respective nozzle opening 250 via the port 22, while the other end of the resistor 24 is connected to the port 23 which directs ink to the recirculation return manifold 19 through the ascender 230 in the descender plate 17.

The ink 170 enters the printhead assembly 10 through the ink inlet 11, flows through the throughhole 200 in the collar 14, into slot 45 of the integrated recirculation manifold 15, through throughholes 44 (FIG. 4A), and into a refill chamber 191 (FIG. 4E) before the ink is directed to individual pumping chambers 2201 associated with a respective nozzle opening 250. Ink from the pumping chambers may be jetted from a specific nozzle opening 250, or the ink may not be jetted from the nozzle opening 250 and is instead directed through the nozzle recirculation resistor 24 for that specific nozzle opening 250 and return to the recirculation return manifold 19 before it is combined with the ink exiting the refill recirculation resistor 42 associated with the refill chamber 191 and directed out of the printhead assembly 10 through the ink outlet 12.

Figure 2:
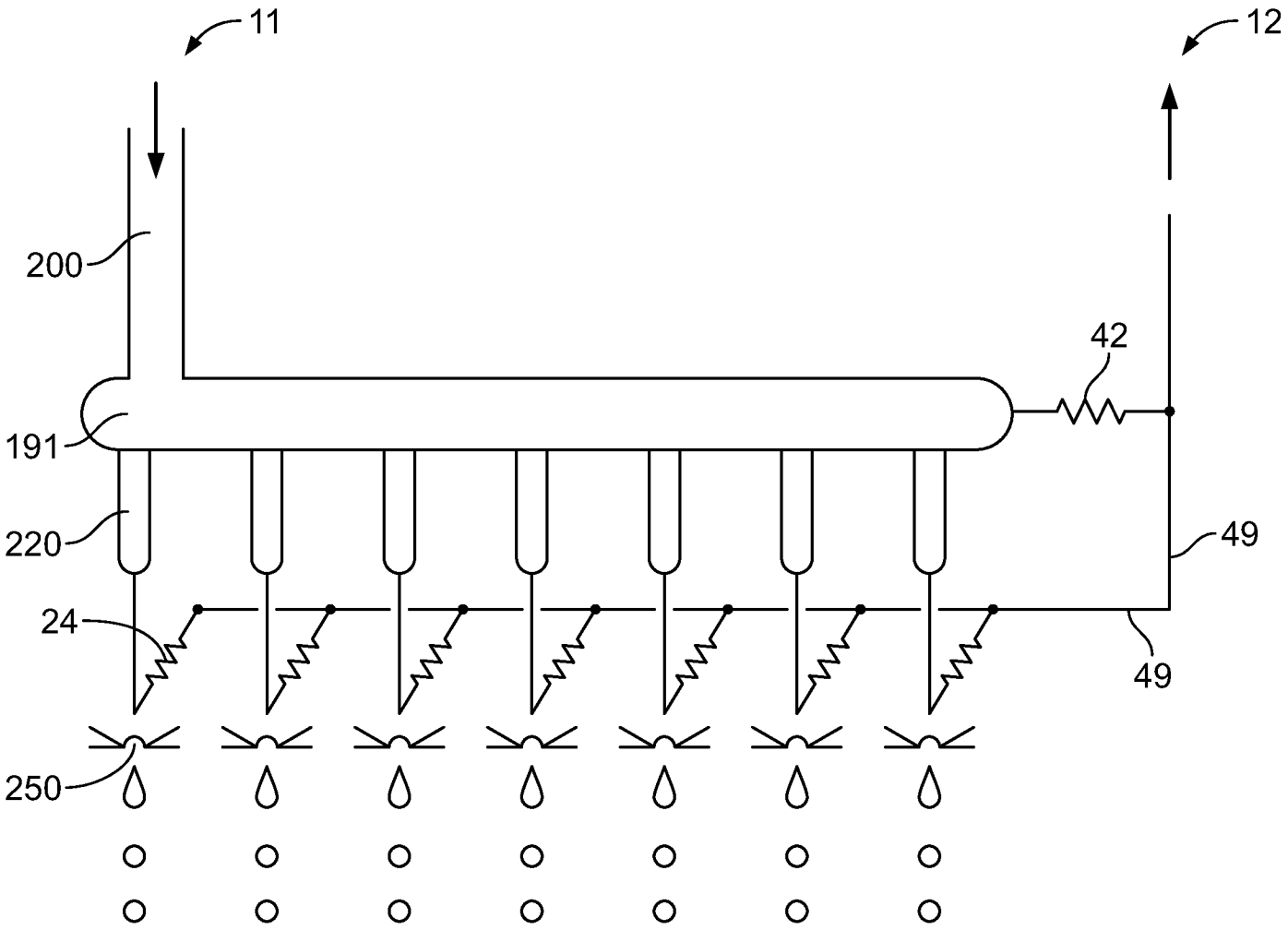
FIG. 2 is a schematic representation of fluidic connections within the printhead assembly.

FIG. 2 illustrates fluidic connections within the printhead assembly 10. Ink from reservoir 110 enters the ink inlet 11 and is relayed by an ink supply (that includes piping 1100 and the coupler 1105) to the refill chamber 191. One end of a refill recirculation resistor 42 is connected in series to the refill chamber 191 while the other end of the refill recirculation resistor 42 is connected to a fluidic path that leads to the ink outlet 12. The refill chamber 191 supplies ink 170, in parallel, to all the pumping chambers 2201 of the printhead assembly 10. In some printhead assemblies, there may be 1024 pumping chambers. The total number of pumping chambers in each printhead assembly equals the total number of nozzle openings in the printhead assembly. The fluid flow path between each pumping chamber 2201 and its corresponding nozzle opening 250 is independent of the other fluid flow paths connecting other pumping chambers to their respective nozzles. In other words, there are as many independent, parallel fluidic flow paths from the pumping chambers 2201 as nozzles. Between each pumping chamber 2201 and each nozzle opening 250 is an inlet to a nozzle recirculation resistor 24. As a result, each fluidic path from the refill chamber 191 to the nozzle opening 250 has a specific nozzle recirculation resistor 24. All the nozzle recirculation resistors are connected in series to a recirculation return manifold 19. The ink leaving recirculation return manifold 19 merges with the ink returning from the refill chamber 191 before all the return ink is directed out of the printhead assembly 10 through ink outlet 12.

Figure 3A:
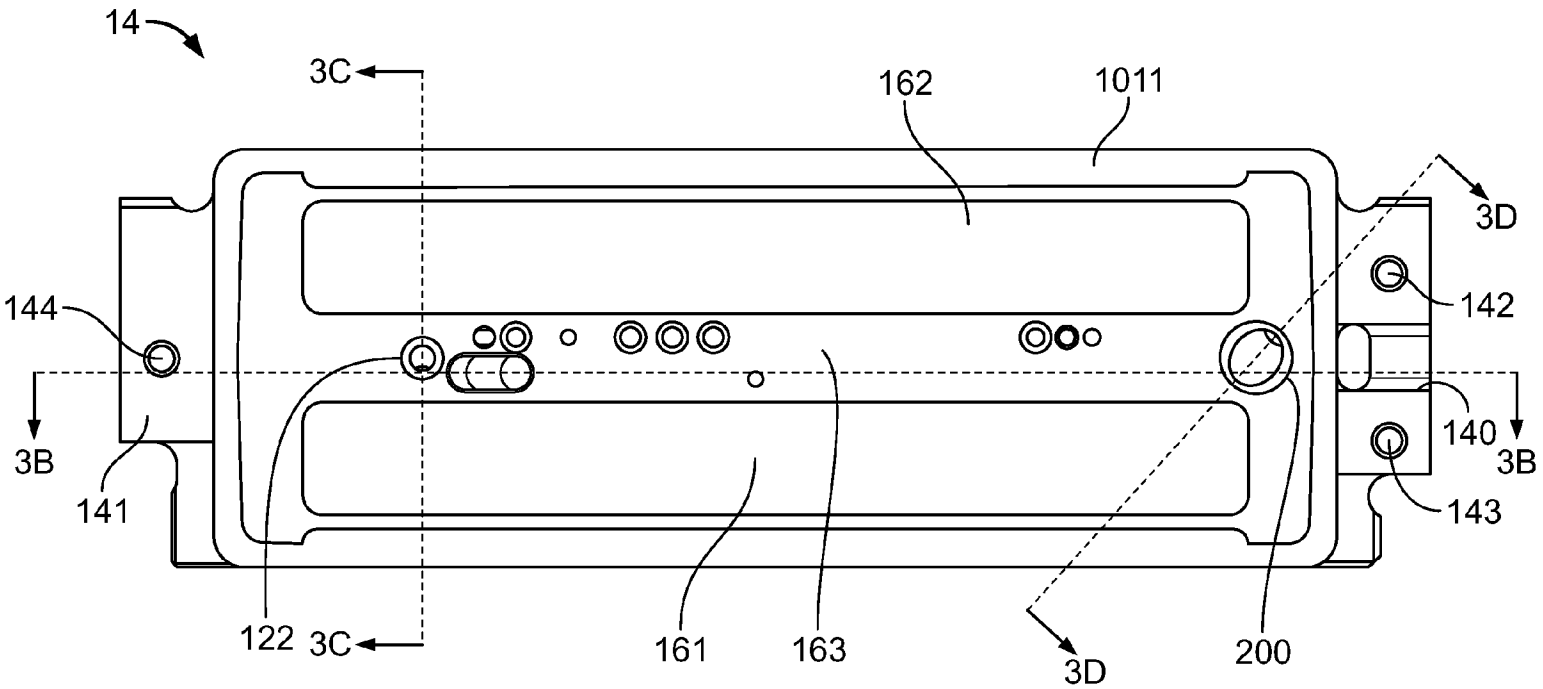
FIGS. 3A-3E are top, side, left end, right end, and bottom views of a collar.
Figure 3B:
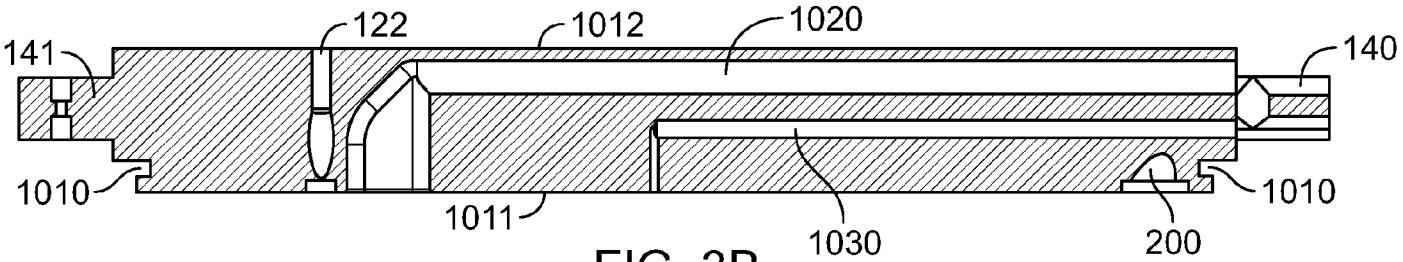
Figure 3D:
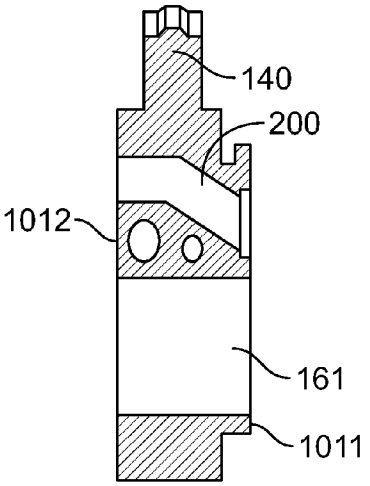
Figure 3C:
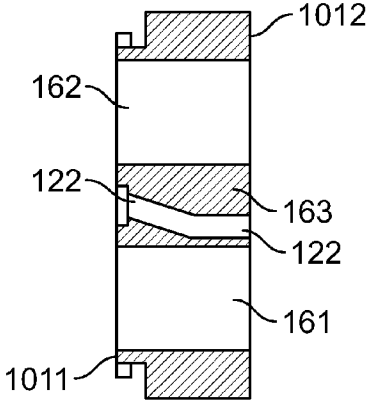
Figure 3E:
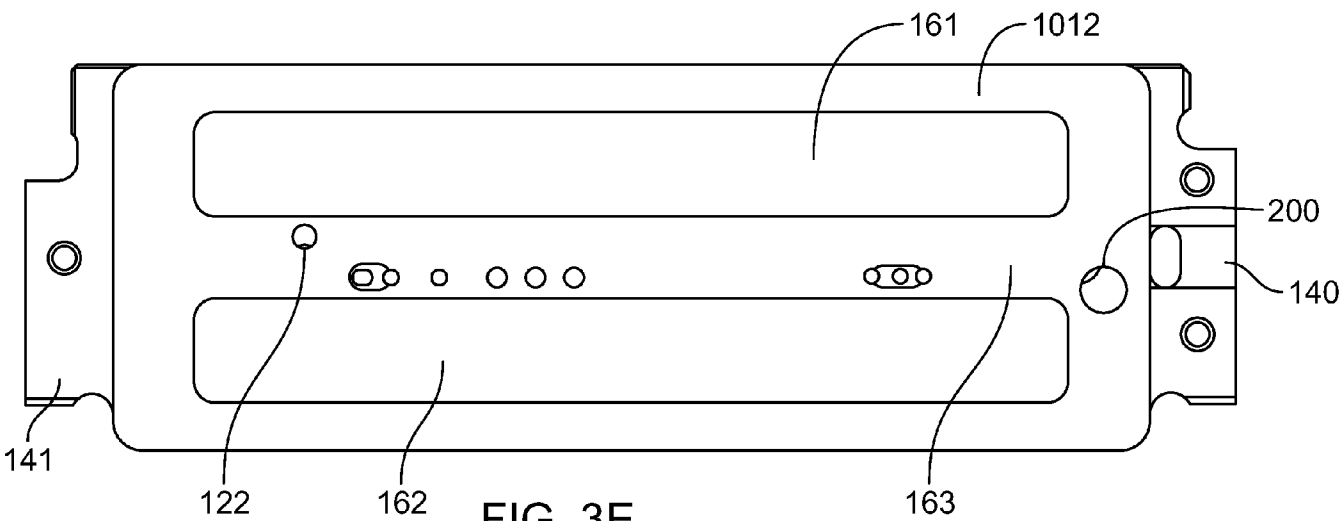

FIGS. 3A-3D show details of the collar 14. The throughhole 200 in the wall 163 receives ink flowing down the piping 1100 from the ink inlet 11 through the coupler 1105 to the throughhole 200. The throughhole 200 does not extend straight through the collar 14. Instead, the opening of the throughhole 200 on a top surface 1011 of the collar 14 is offset from the opening of throughhole 200 on the bottom surface 1012 of the collar 14 as shown in the cross section illustrated in FIG. 3D. Similarly, the top and bottom surface openings of the throughhole 122 which receives ink from the recirculation return manifold 19 and a refill recirculation resistor 42 is also offset, as shown in FIG. 3C. The ink entering the throughhole 122 flows through the coupler 1110 into the piping 1115 before leaving the printhead assembly 10 through ink outlet 12. Grooves 1010 on either side of the collar 14 (shown in FIG. 3B), are used to engage the projecting rim 1008 on the housing 13. A top channel 1020 allows a cartridge heater (typically the shape of a long round rod) to be inserted. The cartridge heater can be used to heat up the ink 107 contained within each of the array modules 16A-16D. A lower channel 1030 provides a space through which a thermistor used for temperature sensing can be inserted. The slots 161 and 162 in the collar 14 can each accommodate two inkjet array modules (16A-16D).

The flow path of ink that enters the collar 14 through throughhole 200 is as follows: upon leaving the bottom face 1012 of the collar 14, the ink is directed into a slot 45 in the integrated recirculation manifold 15. The slot 45 extends through the entire thickness 1525 (shown FIG. 4C) of the integrated recirculation manifold 15. On the bottom surface 1515 of the integrated recirculation manifold 15 are four additional channels 1521-1524 branching off from slot 45. Each of the channels 1521-1524 is used by one of the inkjet array modules 16A-16D. Ink that is directed into the slot 45 is evenly distributed into each of these branches and delivered to inkjet array modules 16A-16D. At the end of each of these branches is a throughhole 44 that opens vertically to the top surface 1510 of the recirculation manifold 15. The ink flowing through channels 1521-1524 leaves the top surface 1510 of the integrated recirculation manifold 15 through the throughholes 44.

As shown in FIGS. 1B and 1D, inkjet array module 16A-D are mounted within slots 161 and 162. Each array module includes a carbon body 190 (shown in FIG. 4E) in which a refill chamber 191 is defined. A bottom edge 1640 of the carbon body 190 rests on the integrated recirculation manifold 15 when the array modules 16A-D are assembled in the slots 161 and 162 of the collar 14. The hashed portions of FIG. 4E expose the subsurface features of the carbon body 190. When the carbon body 190 of the inkjet array module is assembled within either slot 161 or 162 in the collar 14, and contacts the top surface 1510 of the integrated recirculation manifold 15, the opening of channel 1530 on the edge 1640 of the carbon body 190 lines up with the throughhole 44 of the integrated recirculation manifold 15. In this way, the ink that leaves the top surface 1510 of the recirculation manifold 15 enters the channel 1530 in the carbon body 190 and is directed upwards into the ink refill chamber 191.

Once the ink enters refill chamber 191, three possible flow paths are possible. Some ink follows a first flow path and flows out of the plane of the drawing in FIG. 4E and into the cavity plate 212 which contains pumping chambers 2201. Some ink follows a second flow path and flows into the plane of the drawing and into the cavity plate 213. Both of these flow paths deliver ink to either the nozzle opening 250 or the nozzle recirculation resistor 24.

The third possible flow path delivers ink to the refill recirculation resistor 42. This part of the ink leaves the refill chamber 191 through a channel 1540. The channel 1540 has an opening at the edge 1640 of the carbon body 190 and is aligned to a throughhole 414 in the top surface 1510 of the recirculation manifold 15. The throughhole 414 is connected on the bottom surface 1515 of the integrated recirculation manifold 15 to one of the four branches 1541-1544 defined on the bottom surface 1515. Each of the four throughholes 414 is connected to a respective one of the four branches 1541-1544. Each array module (16A-16D), when mounted within slots 161 or 162, uses one of the four branches for returning ink from the refill chamber to the reservoir. All four branches 1541-1544 are connected at a slot 43 which forms part of a refill recirculation manifold 420. The slot 43 extends through the entire thickness 1525 of the recirculation manifold 15 and is connected to one end of the refill recirculation resistor 42. The other end of the refill recirculation resistor 42 is connected to the throughhole 412 which is aligned to the throughhole 122 in the collar 14.

FIG. 4F shows a cross sectional view of the carbon body 190, stiffener plates 210 and 211, cavity plates 212 and 213 in which pumping chambers 2201 are defined, membranes 1740 and 1741, and piezoelectric plates 1750 and 1751 having piezoelectric elements positioned over each of the pumping chambers 2201. The piezoelectric elements apply forces on the ink in the pumping chambers 2201 and ink flows through a side opening in the cavity plates (more details about the flow paths are described in [0295001], which is incorporated by reference in its entirety) and return to the carbon body 190, entering through a respective orifice 1641 corresponding to a particular pumping chamber. The orifice 1641 opens to descender 192 which includes a 90 degree bend channel (shown in FIGS. 1E and 1F and 4F), with an exit orifice 1642 that is defined in the edge 1640 of the carbon body 190. The exit orifice 1642 is set on the integrated recirculation manifold 15 to line up with the descender 194. There are two rows of orifices 1642 in each inkjet array module, and these rows of orifices line up with the two corresponding rows of descenders 430 defined in the integrated recirculation manifold 15.

Ink that has been pressurized in the pumping chamber 2201 now enters the top surface 1510 of the integrated recirculation manifold 15 through descenders 430 which extend through to the lower surface 1515 of the integrated recirculation manifold 15. The ink then flows down descenders 220 in the descender plate 17 and enters a port 22 in the nozzle recirculation plate 20. At the port 22, ink can either be directed down towards the nozzle plate 21 or it can be drawn by the vacuum applied to the integrated recirculation manifold 15 and the nozzle recirculation plate 20 and flow in a V-shaped fluidic channel 24. The ink that flows towards the nozzle plate 21 leaves the printhead assembly 10 and is ejected from nozzle opening 250 onto a printing medium. The ink that enters V-shaped fluidic channel 24 flows into the port 23 which opens upwards to ascender 230 in the descender plate 17. FIG. 7 illustrates these two possible flow paths in greater detail. The ink 170 leaving the descender 220 in descender plate 17 of the laminate piece 23 enters the port 22 of the nozzle recirculation plate 20. A portion 171 of the ink 170 continues down the nozzle tube 249 of the nozzle plate 21 and forms a meniscus 605 within the nozzle tube 249, a distance away from an exposed side of the nozzle opening 251 in the nozzle plate 21. A portion 172 of the ink 170 is conducted through the V-shaped nozzle recirculation resistor or channel 24 defined within the nozzle recirculation plate 20. The recirculation channels 24 are open on both the top and bottom faces of the nozzle recirculation plate 20. In other words, the height of the recirculation channels 24 is the same as the thickness of the nozzle recirculation plate 21. The descender plate 17 bounds the upper part of the channels 24 while the nozzle plate 21 bounds the lower part of the recirculation channels 24. The portion 172 of the ink reaches the port 23 and is conducted upwards to the ascender 230 in the descender plate 17 before entering the recirculation return manifold 19 (FIG. 4B) on its flow path out of the printhead assembly 10. Solvents in the ink can be resupplied to the ink at the nozzle while dissolved air contained in the ink at the nozzle can be reduced by diffusion back into the fresh ink. The ink does not have to be physically replaced at the nozzle to benefit from recirculation of ink just behind the nozzle.

The diameter 2405 of port 23 is smaller than the diameter 2404 of port 22. The recirculation return has a lower flow rate so the diameter 2405 of the port 23 can be smaller. The diameter of port 22 matches the other part openings (e.g., the descender 220 in the descender plate 17) in the stack that makes up the overall descender structure. The ratio of the amount of ink that flows into the fluidic channel 24 to the amount of ink that flows into the nozzle opening 250 is determined by the back pressure that is applied to the nozzle recirculation plate 20. In other words, there is a pressure differential between the jetting passage (from the port 22 to the nozzle opening 250) and the recirculation circuit (from the port 22 to the fluidic channels 24). The meniscus pressure is typically 1 inch of water (inwg) and the recirculation pressure is typically 10 to 30 inwg, giving a typical ratio of between 10 to 30:1. Generally, the ratio may be greater than 10. The presence of the recirculation flow introduced by the recirculation circuit can be viewed as parasitic losses in the overall jetting of the printhead assembly. Manifestations of such parasitic losses can include lower velocities of ink that is delivered to the nozzle opening 250, and reductions in ink drop mass delivered to the nozzle opening (due to the diversion of some ink into the fluidic channels 24 at port 22). The actual magnitude of the drop mass and velocity reduction are influenced by the variation in the pressure differential between the jetting fluid passage and the recirculation circuit. In addition, the presence of recirculation circuits can also increase cross-talks between jets. While each jet has its own recirculation resistor, and the recirculation fluidic flow runs in parallel, and not in series between different jets, energy can still travel down a recirculation resistor to the recirculation manifold, and then from the recirculation manifold back down a different recirculation resistor to a different jet. As a result, there still exists a fluidic path between different jets that would not have existed without the recirculation structures. The loss of efficiency and crosstalk can be minimized by reducing the amount of acoustic energy that can enter the recirculation system (manifold).

Reducing the recirculation flow and the dimensions of the fluidic channels in the recirculation circuits lessen the demands placed on the control of pressure differentials and also reduces the effect of cross talk between jets.

Due to limitations of manufacturing precision (expressed, for example, as an etching uncertainty of ±x mm), smaller recirculation passages having fine fluidic channels experience greater variations in fluidic resistance and the resulting recirculation flow. For example, for a fluidic channel having a width of 10 microns, an etching uncertainty or tolerance of ±1 micron will result in a 10% variation in its width. Compared with a wider fluidic channel having a width of 1000 micron, the etching uncertainty of ±1 micron will only result in a 0.1% variation in its width. In addition, the adhesive bonding of the nozzle recirculation plate 20 with the descender plate 17 to form the laminate piece 23 may cause the inadvertent deposition of adhesive materials within the thin recirculation channels, blocking the ink's fluidic access through those channels.

In general, non-linear channels are formed in a nozzle recirculation plate, one end of each of the channels opening into a nozzle, and another end of each of the channels is connected to a fluid path that extends out of nozzle recirculation plate. The apparatus includes a plate through which at least portions of ink jetting nozzles extend from one face of the plate to another face of the plate, and V-shaped ink recirculation paths formed in the plate, each path having one end opening into the portion of a corresponding ink jetting nozzle and a second end for coupling to an ink recirculation path external to the plate.

When we use the term fluidic resistance, we broadly include, for example, forces that act on a fluid as it flows through a channel. In some cases, the fluidic resistance can be represented by a parameter that can be a function of a length and a cross-sectional area of the channel. In some examples, fluidic resistance increases as the length of the channel increases, and fluidic resistance decreases as the cross-sectional area of a channel increases.

To minimize the sensitivity of the nozzle recirculation manifold towards such manufacturing uncertainties, the length of the fluidic channels can be maximized (for example, to 100 times the manufacturing tolerance). As described above, fluidic resistance of a channel is a function of the cross-sectional area and length of the channel. In particular, fluidic resistance is directly proportional to the length of the channel and inversely proportional to the cross-sectional area of the channel. By increasing the length of the fluidic channels to a large ratio of the manufacturing tolerance, (and thus increasing the fluidic resistance of the channel), the width (of the cross-sectional area) can then selected to be as large as possible (which reduces the fluidic resistance of the channel), for example, to five times the manufacturing tolerance, such that the product of the length of the cross sectional area yields the desired fluidic resistance. Typically, the height of a fluidic channel is determined by the stock thickness of the stainless steel plate from which the nozzle recirculation manifold plate is fabricated. In general, the thickness of the stainless steel plate is manufactured to a tighter tolerance, for example, of ±8 microns, compared to the etching uncertainty or tolerance of ±15 microns.

Figure 5A:
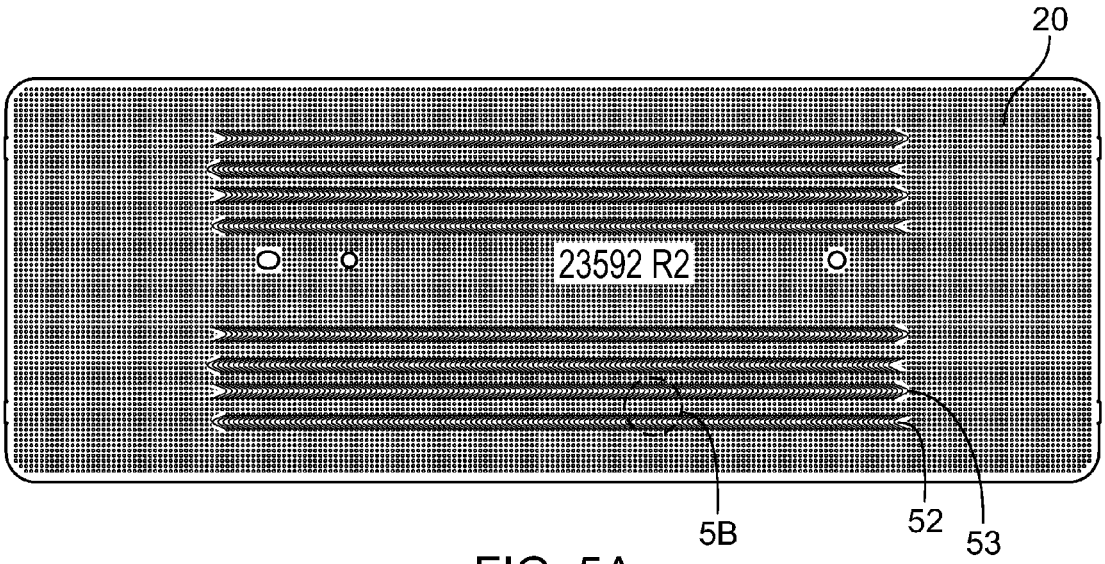
FIGS. 5A-5C are top, and large top, and further enlarged top views of a nozzle recirculation manifold.
Figure 5B:
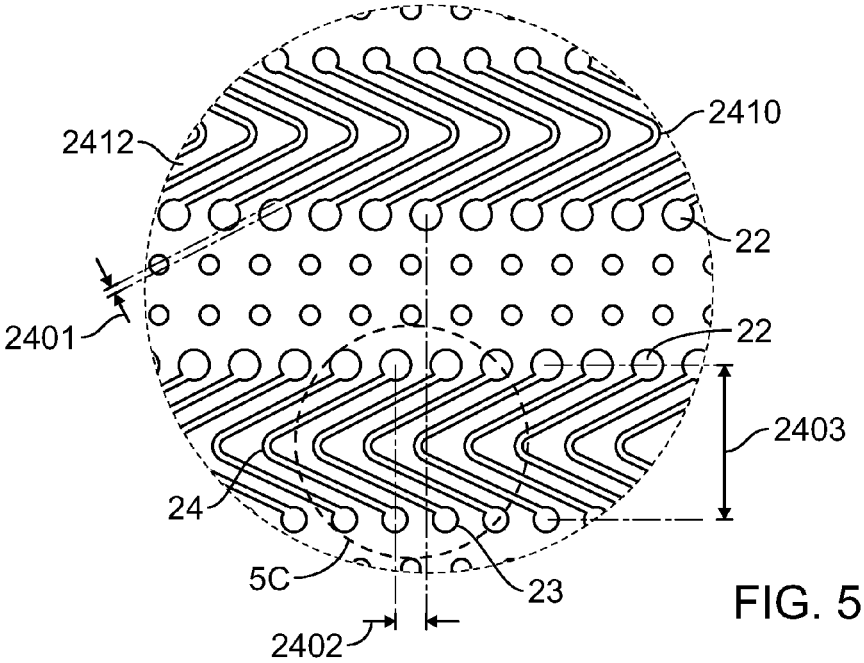
Figure 5C:
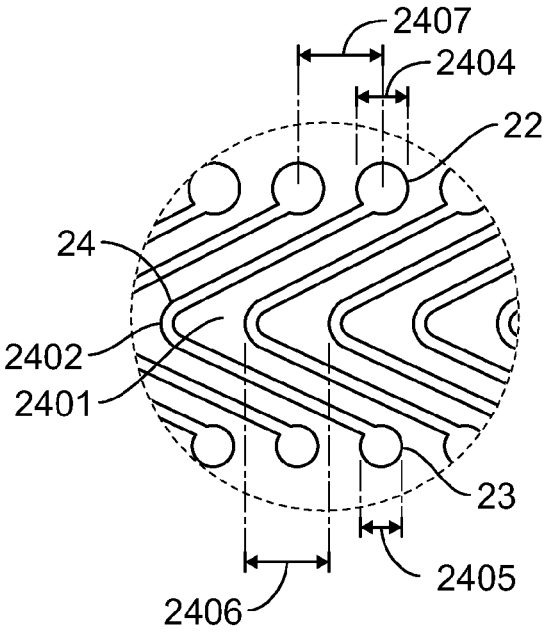

The width 2401 of the V-shaped channel 24 can be 75 microns. This dimension is determined by the material thickness. Given how the parts are fabricated, the material thickness is typically not smaller than 51 microns. As shown in FIG. 5C, while ports 22 and 23 in a particular row 52 line up vertically, there is an offset 2402 between the position of port 22 in one row from the position of port 22 in an adjacent row. The two rows of orifices are offset from one another along the length of the carbon body by a distance that is one half of the spacing between the orifices. The orientation of the V-shape channels also alternates between rows. In one row 53, the pointed end 2410 of the V-shape channels are to the right of the open end 2412 of the V-shape channels, whereas in the adjacent row 52, the pointed end 2410 of the V-shape channel is to the left of the open end 2412 of the V-shape channels. This arrangement helps to conserve space on the nozzle recirculation manifold plate. The angle 2401 of the V-shaped bend of the channel 24 is typically between 40°-60°, for example, 50°. In general, the larger the angle 2401, the longer the fluidic channel 24. The land space between the ports determines the angle, a smaller amount of land space would necessitate a larger angle. For an angle increase of 5°, the length of the fluidic channel is decreased by 0.2 mm. The radius of curvature 2402 of the channel is between 0.10 mm to 0.20 mm, for example, 0.12 mm. Too small a radius of curvature (or too sharp a corner) may cause reflection of the fluid within the fluidic channels, leading to a fluidic pressure reflection. The V-shape formation of the channels helps to increase the land to channel area ratio, optimize the limited area available on the nozzle recirculation plate 20 for the placement of fluidic channels. Reducing the land to channel area ratio reduces the amount of adhesives (e.g. epoxies), for a given amount of fluidic resistance, that are applied on the nozzle recirculation plate 20 to bond with the descender plate 17 to form a laminate piece 23. The pitch of the fluidic channel is identical to the spacing between ports 22 (and thus, the nozzle openings 250). The ink that enters the ascender 230 flows into the recirculation return manifolds 19, defined in the bottom surface 1515 of the integrated recirculation manifold 15, that services that particular row of ascenders. In some cases, there are eight rows of nozzle openings 250 in the printhead assembly that accommodates four inkjet array module (each inkjet array module utilizes two rows of nozzle openings). All eight recirculation return manifolds 19 are connected by perpendicular channels 410 and 411. Perpendicular channels 410 and 411 each has a respective throughhole 412 and 413 that opens to the top surface 1510 of the integrated recirculation manifold 15. Throughholes 412 and 413 bound the two ends of nozzle recirculation return manifold 193 and the throughhole 412 is aligned with the throughhole 122 in the collar 14. As described earlier, the ink entering the throughhole 122 flows through coupling 1110 into the piping 1115 before leaving the printhead assembly 10 through the ink outlet 12. Throughhole 412 also reunites ink from the refill recirculation manifold to the ink from the nozzle recirculation return manifold.

The use of two recirculation circuits, a nozzle recirculation circuit and an ink refill chamber recirculation circuit, connected in parallel and driven by back pressure (i.e., a nominal negative pressure) from a single external vacuum source 120, means that the recirculation of ink in the larger ink refill chamber needs to be controlled carefully to prevent undesirable pressure fluctuations in the meniscus pressure of the ink droplet supported at the nozzle opening 250 of the nozzle plate 21 that are caused by the ink refill chamber recirculation circuit. In general, ink is ejected from the inkjet assembly at a nominal flow rate. The recirculation pressure experienced at the nozzle end of the recirculation flow path is small enough so that any reduction in flow rate below the nominal flow rate when ink is being ejected is less than a threshold, or a change in the nominal negative pressure when ink is not being ejected is less than a threshold, or both. In general, the pressures required for nozzle recirculation are 5 to 10 times the pressure required for the ink refill chamber recirculation, in the absence of any additional fluidic resistance in the refill chamber recirculation. A nozzle recirculation rate and the required pressure are first selected, before the refill resistor is designed to provide a flow similar to the sum of the nozzle recirculation flows from all the jets. When the refill recirculation resistor 42 is introduced between the return ink from the ink refill chamber 191 and the ink outlet 12, the resistor 42 can be designed so that a modest flow can be maintained at a pressure that is easily generated and controlled to within ±20% by the external vacuum source 120. The combined recirculation flow (from the refill chamber and from all the nozzle recirculation flow paths) is about 10% of jetting flow or 10 μcc/sec. Keeping the recirculation flow rates to approximately 10% of the max jetting flow ensures that the effect of recirculation on the meniscus pressure is minimal. Recirculation flow rates in a range of x % to y % would also be useful. Thus, by inserting the appropriate fluidic resistance in the ink refill chamber recirculation circuit, the pressure required to pull the fluids in the two recirculation circuits can be equalized. In other words, by ensuring that the fluidic resistance in each of the recirculation circuits is about equal, or within 50% of each other, a single vacuum source can apply a large pressure that pulls approximately equally on both the nozzle recirculation circuit and the ink refill chamber recirculation circuit. The recirculation passages can have a high resistance of, for example, 5 (dyne/$cm^2$)/($cm^3$/sec)). For example, a vacuum of between 10-40 inches of water (inwg), also known as the recirculation pressure, can be pulled by the vacuum source 120 without influencing a meniscus pressure of the ink at the nozzle opening 250. Such recirculation pressures are relatively easy (inexpensive) to generate and the high resistance makes the flow rate relatively insensitive to pressure fluctuations, making precision control unnecessary. The sum of all the nozzle recirculation flows is about equal to the refill recirculation flow. In other words, the refill resistance is approximately equal to the equivalent parallel resistance of all the nozzle resistances.

Figure 8B:
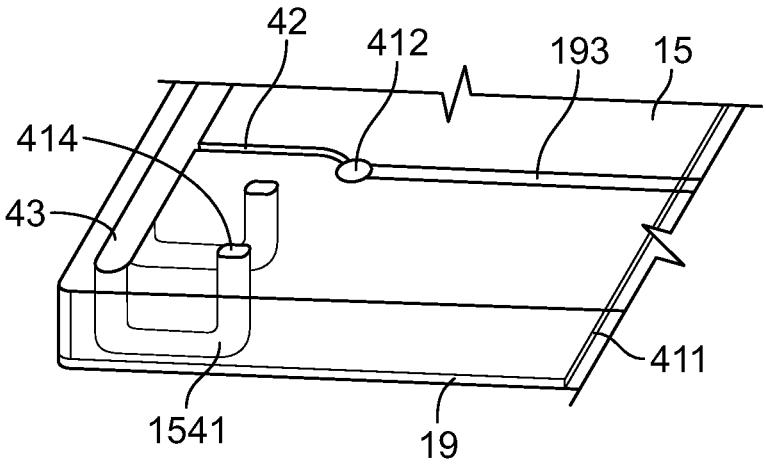

FIG. 8A shows a schematic illustration summarizing the various flow paths of the ink 170 within the printhead assembly 10. Ink 170 enters the printhead assembly 10 through the ink inlet 11 and is channeled to throughhole 200 in the collar 14. The throughhole 200 opens to a slot 45 in the integrated recirculation manifold 15. The slot 45 opens to four channels 1521-1524 (only 1521 is shown in FIG. 8A) defined on the lower surface 1515 of the integrated recirculation manifold 15 (see details in FIGS. 4A-4D). Each of the channels 1521-1524 terminates with a throughhole 44 that opens vertically to the top surface 1510 of the recirculation manifold 15. Throughhole 44 is aligned with an opening 1530 in the carbon body 190 in an inkjet array module 16A. The printhead assembly 10 can accommodate four inkjet array modules 16A-16D (only parts of inkjet array module 16A are shown in FIG. 8A). The opening 1530 leads to ink refill chamber 191. The ink 170 can be conducted out of the refill chamber 191 through the opening 1540. The opening 1540 is aligned with throughhole 414 which opens to the channel 1541 defined on the lower surface 1515 of the integrated recirculation manifold 15. The channel 1543 leads to a slot 43 which is connected to the refill recirculation resistor 42, defined on the top surface 1510 of the manifold 15 (shown in more detail in FIG. 8B). The refill recirculation resistor 42 terminates at the throughhole 412 which is aligned with the throughhole 122 in the collar 14. The ink 170 then flows to the ink outlet 12 via the throughhole 122 and exits the printhead assembly 10. The ink path of the ink 170 through the opening 1540, into the channel 154, the slot 43 and the refill recirculation resistor 42 is the flow path associated with the recirculation of the refill chamber.

At the ink refill chamber 191, some ink 170 flows laterally (into and out of the plane of the drawing in FIG. 8A, only ink flowing out of the plane of the drawing is shown in FIG. 8A) through a similar passage defined in the upper portion of the stiffener plate 211 through to the cavity plate 213 having individual pumping chambers 2201. When ink is jetted by piezoelectric elements associated with the pumping chambers 2201 (not shown), the ink 170 is forced out of the lower portion of the pumping chamber and enter orifices 340 defined in the stiffener plate 211 before entering the carbon body 190 through orifices 1641 (see FIG. 4E for more details). The ink 170 negotiates the 90 degrees bend in the descender 192 in the carbon body 190 before entering the descender 194 in the integrated recirculation manifold 15 (FIG. 1E). The ink 170 then passes through the descender 220 in the descender plate 17 and reaches port 22 in the nozzle recirculation plate 20. Here, some ink 170 is conducted to nozzle opening 250 in the nozzle plate 21 while some ink passes through the V-shaped channel 24 to port 23 before the ink is conducted up to the ascender 230 in the nozzle plate 17 which is aligned with the recirculation return manifold 19 defined in the lower surface 1515 of the integrated recirculation manifold 15 (see FIG. 4B). The ink 170 is then conducted by channels 411 and 193 to the throughhole 412 before it is expelled from the printhead assembly 10 through the ink outlet 12. The low flow-high resistance recirculation system described above is implemented by taking advantage of the laminate structure common to the nozzle stack (nozzle plate 21, the collar 14, the descender plate 17) of the inkjet array modules 16A-D. The additional layer (i.e. nozzle recirculation plate 20) is inserted between the nozzle plate 21 and the rest of the array module 16A-D that contains the recirculation passages (one for each jet) and provides ports to a recirculation manifold.

Other implementations are also within the following claims.

What is claimed is:

1. An apparatus, comprising:

an inkjet assembly comprising a plurality of nozzles;

a reservoir separate from the inkjet assembly; and a recirculation flow path in fluid communication with one of the nozzles and the reservoir so that, during use of the apparatus, a portion of an ink in the nozzle is not ejected from the nozzle and flows from the nozzle through the recirculation path to the reservoir.

2. The apparatus of claim 1, wherein the apparatus is configured so that, during use of the apparatus, the portion of the ink flows in the recirculation path at a rate that is 10% of a flow rate of the ink when it is ejected from the nozzle.

3. The apparatus of claim 1, wherein, during use of the apparatus, ink flows at a flow rate as it is ejected from the nozzle, or ink is held under a negative pressure associated with a characteristic of a meniscus of the ink in the nozzle when ejection of ink from the nozzle is not occurring.

4. The apparatus of claim 3, wherein the recirculation flow path has a nozzle end at which it opens into the nozzle and a second location spaced from the nozzle end which, during use of the apparatus, is subjected to a recirculation pressure lower than the negative pressure so that the ink is recirculated from the nozzle through the recirculation flow path.

5. The apparatus of claim 4, wherein the recirculation flow path has a fluidic resistance between the nozzle end and the second location such that, during use of the apparatus, a recirculation pressure at the nozzle end of the flow path that results from the recirculation pressure applied at the second location of the flow path is small enough that any reduction in flow rate below the flow rate when ink is being ejected is less than a threshold.

6. The apparatus of claim 5, further comprising a nozzle recirculation plate, wherein the fluidic resistance is defined in the nozzle recirculation plate.

7. The apparatus of claim 6, wherein a V-shape channel of the nozzle recirculation plate defines the fluidic resistance.

8. The apparatus of claim 7, wherein a length of the V-shape channel is substantially greater than a width of the V-shape channel.

9. The apparatus of claim 7, wherein a radius of curvature at a bend in the V-shape channel is large enough to prevent fluidic reflections at the bend.

10. The apparatus of claim 5, wherein the fluidic resistance is 5 $(\text{dyne/cm}^2)/(\text{cm}^3/\text{sec})$).

11. The apparatus of claim 5, wherein the recirculation pressure at the nozzle end of the flow path is small enough that a change in the negative pressure when ink is not being ejected is less than a threshold.

12. The apparatus of claim 4, wherein the recirculation flow path has a fluidic resistance between the nozzle end and the second location such that, during use of the apparatus, a recirculation pressure at the nozzle end of the flow path that results from the recirculation pressure applied at the second location of the flow path is small enough so that a change in the negative pressure when ink is not being ejected is less than a threshold.

13. The apparatus of claim 3, wherein a magnitude of the negative pressure is more than 10 times greater than a magnitude of a meniscus pressure.

14. The apparatus of claim 3, wherein the negative pressure is between 10-40 inches of water (inwg).

15. The apparatus of claim 1, wherein the recirculation flow path is configured to direct the portion of ink away from the nozzle during use of the apparatus.

16. The apparatus of claim 1, further comprising a refill chamber and a second recirculation flow path that extends from the refill chamber.

17. The apparatus of claim 16, wherein the refill chamber is defined in a body of the inkjet assembly.

18. The apparatus of claim 17, wherein the body comprises carbon.

19. The apparatus of claim 16, wherein the second recirculation flow path directs ink out of the inkjet assembly.

20. The apparatus of claim 16, wherein the inkjet assembly further comprises an integrated recirculation manifold.

21. The apparatus of claim 20, wherein the integrated recirculation manifold is in fluid communication with the recirculation flow path and the second recirculation flow path.

22. The apparatus of claim 20, wherein the inkjet assembly further comprises:

a nozzle recirculation plate defining V-shape channels;

a nozzle plate;

a descender plate; and a collar, wherein:

the nozzle recirculation plate is positioned between the nozzle plate and the descender plate;

the integrated recirculation manifold is positioned between the collar and the descender plate; and a carbon body of the inkjet assembly is in contact with the integrated recirculation manifold.

23. The apparatus of claim 16, wherein the recirculation flow path and the second recirculation flow path are fluidically connected in parallel.

24. An apparatus, comprising:

an inkjet assembly comprising a plurality of nozzles;

a reservoir separate from the inkjet assembly; and a recirculation plate defining V-shaped portions of recirculation paths, each recirculation path being in fluid communication with a respective one of the nozzles and the reservoir so that, during use of the apparatus, a portion of an ink in the nozzle flows from the nozzle through the recirculation path to the reservoir.

25. An apparatus, comprising:

an inkjet assembly comprising a plurality of nozzles and a refill chamber;

a reservoir separate from the inkjet assembly;

a first recirculation path in fluid communication with one of the nozzles and the reservoir so that, during use of the apparatus, a portion of an ink in the nozzle flows from the nozzle through the recirculation path to the reservoir; and a second recirculation flow path to direct ink out of the inkjet assembly.

* * * * *